US008132872B2

(12) United States Patent
Prosa

(10) Patent No.: US 8,132,872 B2
(45) Date of Patent: Mar. 13, 2012

(54) WASTE RECEPTACLE

(76) Inventor: Troy Prosa, Minneapolis, MN (US)

( * ) Notice: Subject to any disclaimer, the term of this patent is extended or adjusted under 35 U.S.C. 154(b) by 0 days.

(21) Appl. No.: 12/778,599

(22) Filed: May 12, 2010

(65) Prior Publication Data

US 2010/0219191 A1 Sep. 2, 2010

Related U.S. Application Data

(63) Continuation-in-part of application No. 12/428,063, filed on Apr. 22, 2009.

(60) Provisional application No. 61/048,717, filed on Apr. 29, 2008.

(51) Int. Cl.
*A47B 95/02* (2006.01)
*B65D 43/26* (2006.01)
*A47G 29/12* (2006.01)

(52) U.S. Cl. ..... 312/319.9; 220/264; 232/43.2

(58) Field of Classification Search ..... 312/249.8, 312/349.9, 305, 310, 311, 319.9, 334.27, 312/270.1, 270.3, 212, 249.9; 232/30–32, 232/43.2; 220/495.11, 495.08, 908.1, 264, 220/263, 262

See application file for complete search history.

(56) References Cited

U.S. PATENT DOCUMENTS

| | | | | |
|---|---|---|---|---|
| 1,240,740 A | | 9/1917 | Levett | |
| 1,899,372 A | * | 2/1933 | Walter | 312/305 |
| 1,917,363 A | * | 7/1933 | Fohn | 312/212 |
| D137,448 S | | 11/1943 | Deutsch | |
| 2,622,956 A | * | 12/1952 | White | 312/304 |
| 2,699,368 A | * | 1/1955 | Selmer | 312/270.3 |
| 2,827,354 A | * | 3/1958 | Wassell et al. | 312/305 |
| 2,841,458 A | * | 7/1958 | Selmer | 312/270.3 |
| 2,934,390 A | * | 4/1960 | Wright | 312/270.3 |
| 3,183,050 A | * | 5/1965 | Hudson | 312/270.3 |
| 3,322,477 A | * | 5/1967 | Armijo | 312/211 |
| 3,627,395 A | * | 12/1971 | Hoey | 312/305 |

(Continued)

FOREIGN PATENT DOCUMENTS

EP 426956 A1 * 5/1991

OTHER PUBLICATIONS 8400, 8405 Full Extension Box or File Drawer Slide, Knape & Vogt Manufacturing Company, 3 pgs.

(Continued)

*Primary Examiner* — Darnell Jayne
*Assistant Examiner* — Andrew Roersma
(74) *Attorney, Agent, or Firm* — Westman, Champlin & Kelly, P.A.

(57) ABSTRACT

A waste receptacle has an outer cabinet housing and a waste or trash bag support frame that can be moved from a position where it is at least partially within the cabinet, to a position where the support frame is extended sufficiently so it can be rotated about an upright axis to provide access to a bag held on the support frame. The support frame has an open ring on which a waste bag can be placed. The ring is spaced upwardly from the bottom of the bag support frame so that when the waste bag is full, it can be detached from the ring and dropped down for removal, rather than being lifted up through a container opening or support. The waste receptacle can have a cover that can be actuated to move from a closed position overlying the bag support frame to an open position.

27 Claims, 25 Drawing Sheets

U.S. PATENT DOCUMENTS

| | | | | | |
|---|---|---|---|---|---|
| D231,139 | S | | 4/1974 | Stahel, II | |
| 3,807,826 | A | * | 4/1974 | Peckenpaugh | 312/305 |
| D232,932 | S | | 9/1974 | Stahel, II | |
| 3,890,890 | A | * | 6/1975 | Hennells | 100/48 |
| D242,595 | S | | 12/1976 | De Lise et al. | |
| 4,639,050 | A | * | 1/1987 | Neuhaus | 312/273 |
| 4,946,118 | A | * | 8/1990 | Hastings | 248/97 |
| 5,013,102 | A | * | 5/1991 | Loblein | 312/234.1 |
| 5,244,270 | A | * | 9/1993 | Parker | 312/270.2 |
| 5,588,358 | A | * | 12/1996 | Klepacki et al. | 100/349 |
| 5,901,872 | A | * | 5/1999 | Zollinhofer et al. | 220/573 |
| D416,658 | S | | 11/1999 | Houry | |
| D418,650 | S | | 1/2000 | Neuhaus | |
| D442,346 | S | | 5/2001 | Prosa | |
| 6,390,321 | B1 | * | 5/2002 | Wang | 220/264 |
| 2007/0024166 | A1 | * | 2/2007 | Sung | 312/319.9 |

OTHER PUBLICATIONS

Precision Ball Bearing Slides—Soft Close 8400s Hardware Distributors Ltd. 2008, 2 pgs.

* cited by examiner

WASTE RECEPTACLE

This application refers to and claims priority on U.S. Provisional Patent Application No. 61/048,717, filed Apr. 29, 2008, and this application is also a continuation in part of U.S. application Ser. No. 12/428,063, filed Apr. 22, 2009, and hereby claims priority on said application Ser. No. 12/428,063, the contents of both of the above-identified applications is hereby incorporated by reference.

BACKGROUND OF THE INVENTION

The present disclosure relates to a waste receptacle that has an exterior housing, and a waste bag support which can be retracted into the housing until an actuator is moved to permit the waste bag support and a supported waste bag to be extended out from the housing. When the waste bag support is extended, it can be rotated about a vertical axis for access to a bag on the waste bag support.

Various trash bag holders have been advanced, as well as garbage containers that hold trash bags. Many of these have hinged doors that are openable by pushing them inwardly. There are other types of receptacles and receptacle covers that will pivot open.

Removing full trash or waste bags from the waste containers generally requires lifting off a cover, or otherwise opening the entire top of the container or outer housing and then listing the full bag up over the container top for removal. This is inconvenient, and time consuming.

SUMMARY OF THE INVENTION

The present disclosure provides a waste receptacle that utilizes a stationary outer housing or cabinet that compliments the interior décor of a building, and which has a moveable trash or waste bag support frame mounted for movement into and out of the outer housing. The waste or trash bag support frame has a part cylindrical outer wall, and has a waste bag support ring or hoop on a back side of the wall. The waste bag support frame and the bag support ring or hoop can be slid outwardly from the cabinet and rotated about an upright axis for removable of a full trash bag. The removal is done by releasing the bag from the ring, and dropping the bag down to the floor or ground. A clean trash bag can be replaced on the support ring. The waste bag support frame is maintained in place in the cabinet when in use, and a foot actuator can be operated to open a cover, when a cover is provided, and release the waste bag support frame to permit moving the waste bag support frame to an extended position.

In one form of the disclosure, the cover is an eyelid type or part spherical cover that is pivotally mounted above the part cylindrical wall to cover an access opening to the bag above the part cylindrical wall, which extends to the exterior of the cabinet. The bottom edge of the cover is part circular and mates with the top edge of the part cylindrical outer wall of the support frame.

The cover hinge utilizes a pivot support that will provide damping as the cover is opened or closed.

The combined movement of sliding the bag support frame out of the cabinet and rotating the waste bag support frame so the bag support ring and the bag are completely out of the cabinet provides for easy access to the bag for removal and replacement. The top of the full bag can be dropped below the ring and removed without the need for lifting the full bag over the ring.

The unit is easily operated, compact, and reliable.

DETAILED DESCRIPTION OF EXEMPLARY EMBODIMENTS

Figure 1:
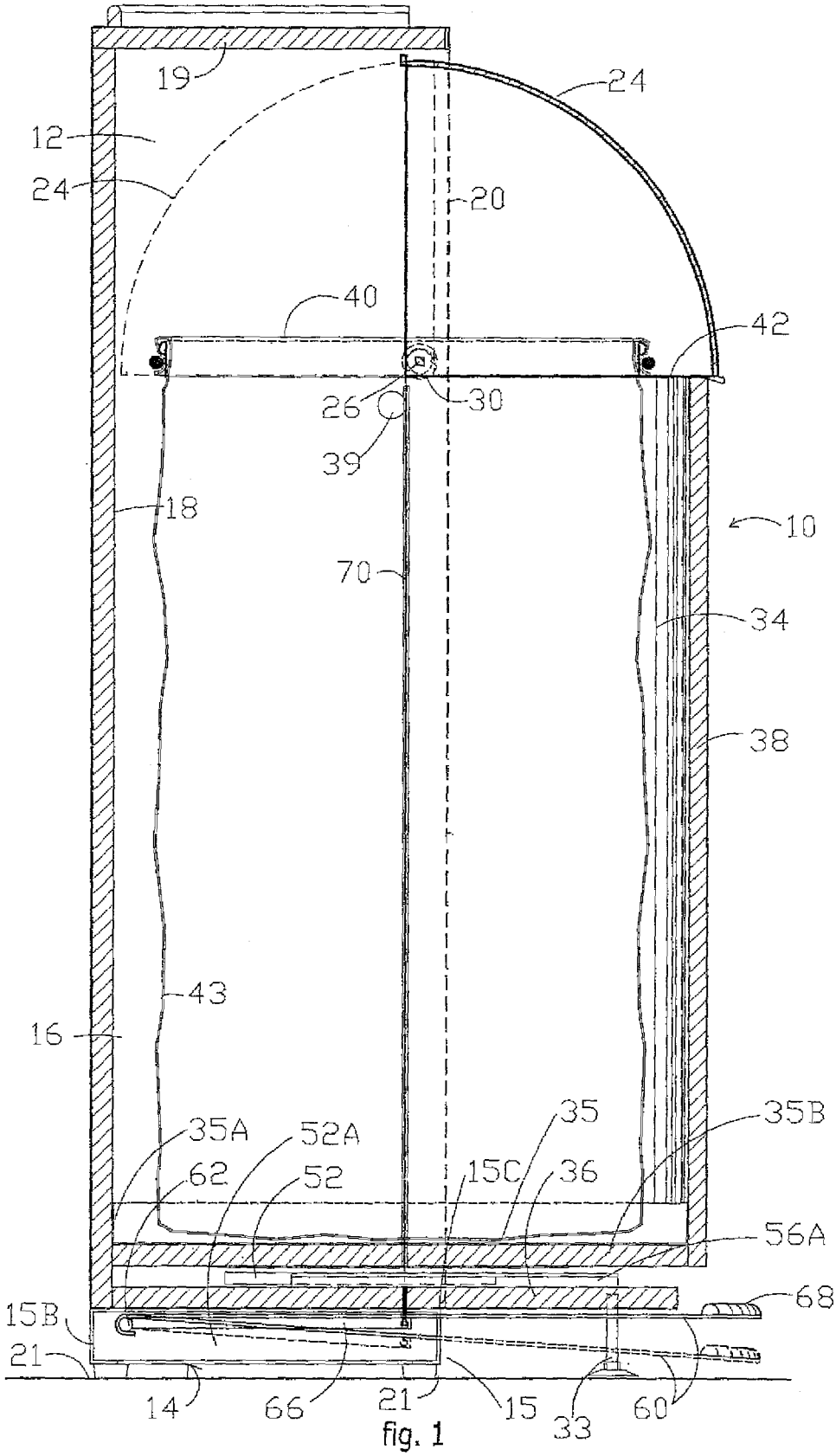
FIG. 1 is a vertical sectional view of a waste receptacle made according to the present disclosure and taken on line 1-1 in FIG. 2.

A waste receptacle assembly of a first embodiment, indicated generally at 10, includes an outer cabinet 12 that has a support base 14, spaced apart side walls 16, 16, a top wall 19, a rear wall 18 and a bottom wall 36, that are secured together to form a cabinet. In addition, the cabinet 12 has a front panel 20 that only partially covers the upper portion of an open front of the cabinet. The support base 14 comprises a rectangular frame 15 having side members 15A, a rear member 15B and a front member 15C. The frame 15 supports the bottom wall 36. Leveling feet 21 are provided at the corners of support base 14, and a pair of leveling feet 33 support a forwardly extending, curved front edge portion of the bottom wall 36. (See FIG. 6).

As shown the front panel 20 has a center part circular opening 22. A part spherical cover 24 is pivotally mounted on suitable pivot supports 26 on the opposite side walls 16, 16 of the cabinet. As will be explained, at least one of the pivot support assemblies includes a pivot support torque damper mechanism 30 that is operated with a foot actuator 60, as will be explained to move the cover 24 from its closed position shown in solid lines in FIG. 1 to its dotted line open position, also shown in FIG. 1. In the open position of the cover 24, an opening is provided for access to a waste bag.

The pivot support and damper mechanism 30 will prevent the cover from slamming down as the center of gravity of the cover goes over center as it is closed. A spring may be mounted to provide a return force to tend to close the open cover. The cover may be initially moved to be closed manually. The cover 24 is held in open position with a manual latch 25 that rotates manually between a locked and open position, as shown. A spring loaded detent to hold the cover 24 open also can be used.

A waste bag support or carrier frame 34 is made as a separate unit from the cabinet and the cover 24. The bag support frame 34 includes a bottom or base metal, or other leak proof material, pan 35 with a peripheral wall 35A (See FIG. 3) and a curved or semi-circular cross section upright front wall 38. The wall 35A of pan 35 is secured to the upright front wall 38. The metal pan 35 is also supported on a support wall 35B that is secured to the curved upright front wall 38. The support wall 35B extends to the rear to fully support the pan 35, as shown in cross section in FIG. 6. As can be seen, the front wall 38 extends upwardly and is a half of a right circular cylinder that extends substantially 180° around the circular pan 35. The front wall 38 also extends upwardly to height below the cover 24 when the cover is closed, and the part-circular upper edge of wall 38 mates with the part circular bottom edge of the closed cover. In other words, the lower edge of the cover 24 is substantially the same size and shape as the upper edge of the part cylindrical front wall 38. The side edges of the curved front wall 38 are spaced apart by a diameter of the pan 35.

Figure 3:
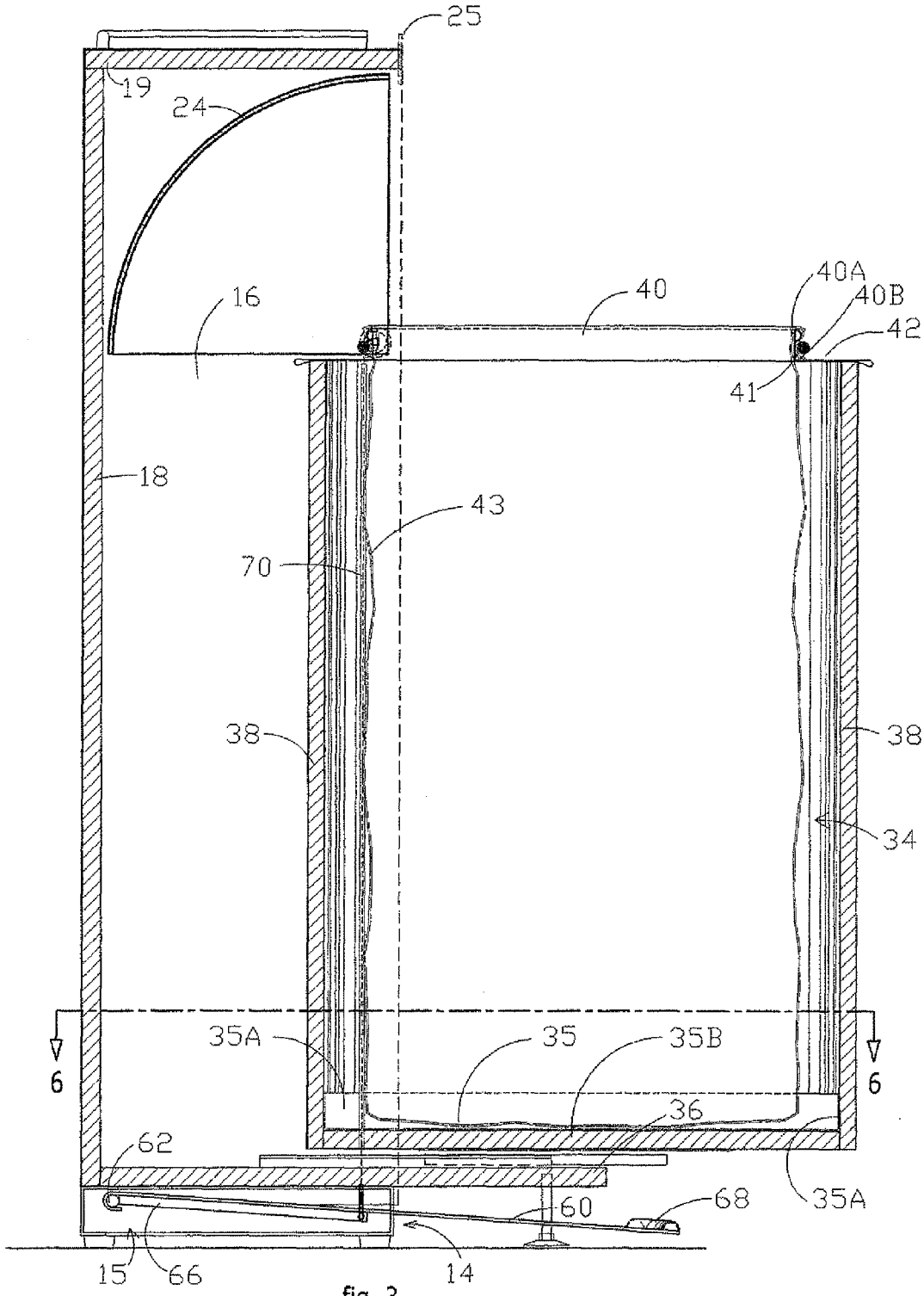
FIG. 3 is a side view of the waste receptacle of the disclosure showing a waste bag support frame in an open partially rotated position.
Figure 4:
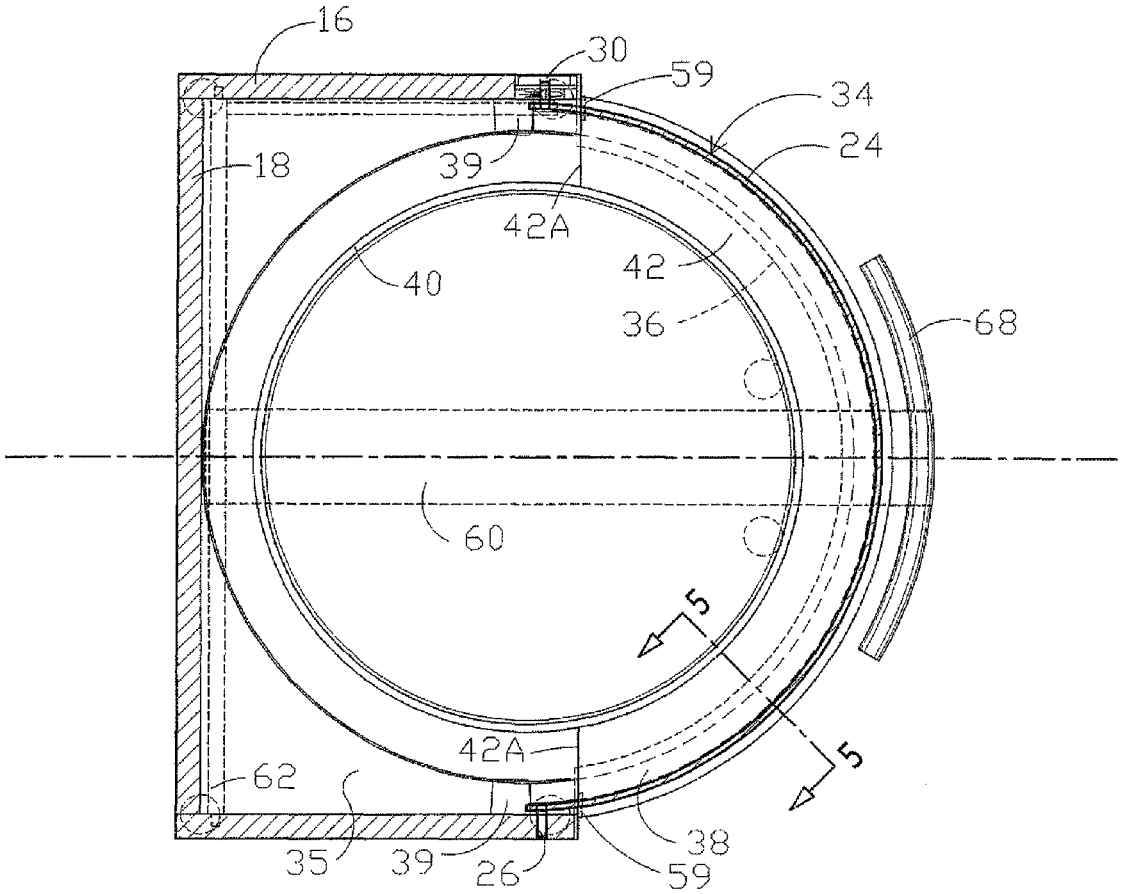
FIG. 4 is a sectional view taken as on line 4-4 in FIG. 2.

The front wall 38 forms a rigid upright support that in turn mounts a waste or trash bag support ring 40, which ring 40 is mounted on a metal support flange or top plate 42 mounted on the upper end of wall 38. The top plate 42 is part circular and has ends 42A (FIG. 4). The top plate 42 has a rolled outer edge, as shown. The support ring 40 extends horizontally outwardly from the backside of the front wall 38. The ring 40 thus overlies the base pan 35. As can be seen in FIG. 3, a waste or trash bag 43 of thin conventional plastic can be supported on the support ring 40 by placing the top portion of the bag 43 on the interior of the ring 40 and folding the edge portion of the open upper portion of the bag over the ring generally as shown in FIG. 5.

The upright front wall 38 extends outwardly from the front of the cabinet 12. The diameter of the half cylinder front wall 38 is slightly less than the space between the side walls 16 of the cabinet and the diameter plane between the edges of the half cylinder from the wall lies substantially along the front plane of the cabinet 12, but can extend into the cabinet 12 a short distance when it is retracted to the position shown in FIG. 1.

Suitable cushioning bumpers 39 are secured to both of the side walls 16 of the cabinet 12 at a level near the top of the upright front wall 38, and are located to provide stops for the edges of the half cylinder wall 38 when the carrier frame 34 is retracted into the cabinet, and to rotate the carrier frame to its proper position if it is partially rotated when the carrier frame is retracted into the cabinet.

Figure 5:
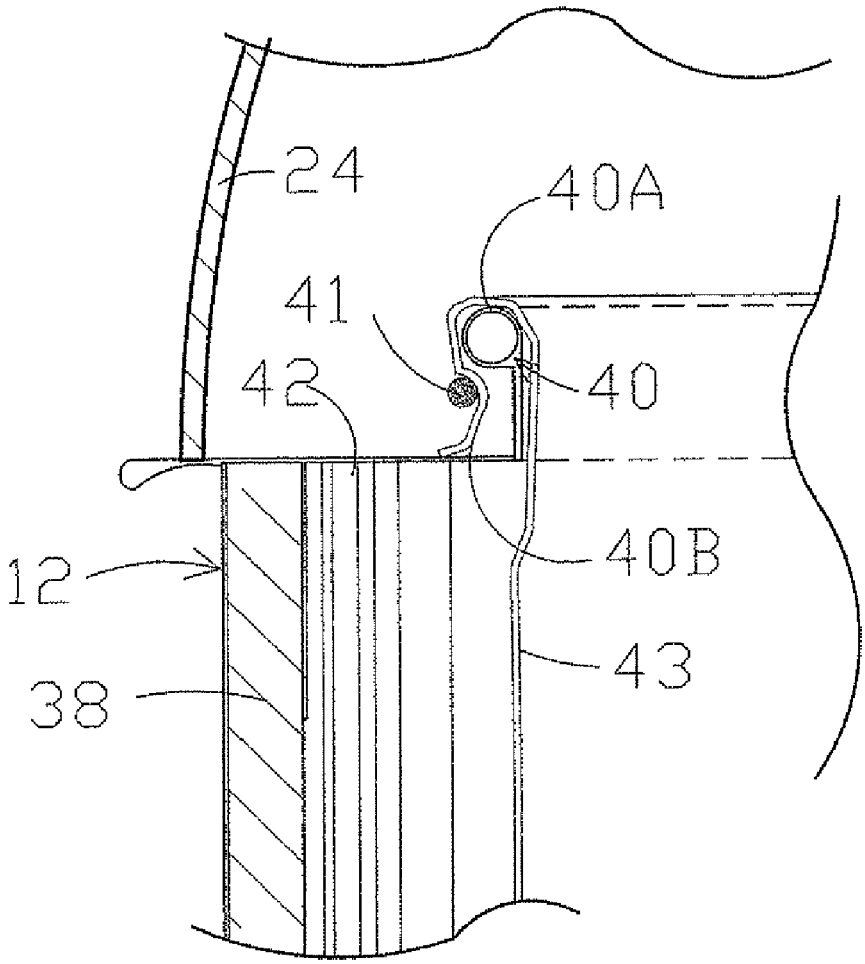
FIG. 5 is an enlarged sectional view taken on line 5-5 in FIG. 4.
Figure 7:
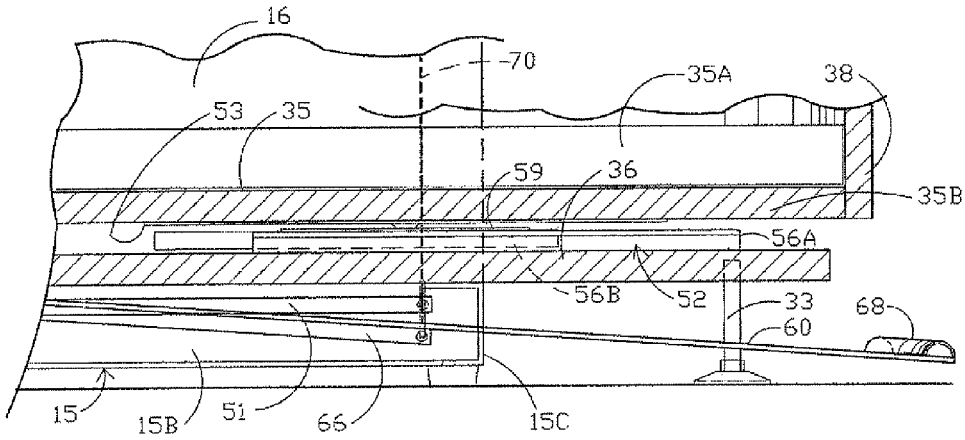
FIG. 7 is a fragmentary enlarged sectional view of a lower portion of the waste receptacle taken along the same line as FIG. 1.

Ring 40, as shown in FIGS. 5 and 7 has a rounded interior surface and a tubular top edge shape 40A that forms a recess 40B below the tube 40A, so that the top edge of the open end of the waste bag 43 can be folded over the top edge tube of ring 40 and then held in place in a suitable manner. The bag 43 can be held in place by utilizing a rubber band or ring 41 around the folded bag top on the outside of ring 40 to retain the edge of the bag on the ring. Maintaining even a slight tension in the ring 41 will hold a bag in place. The bag 43 can be of size so that it is supported on the bottom plate or panel 36, when it is filled. The bag 43 can also be held in other ways, for example with clips that fit over the folded top part of the bag and which grip the support ring 40.

Figure 11:
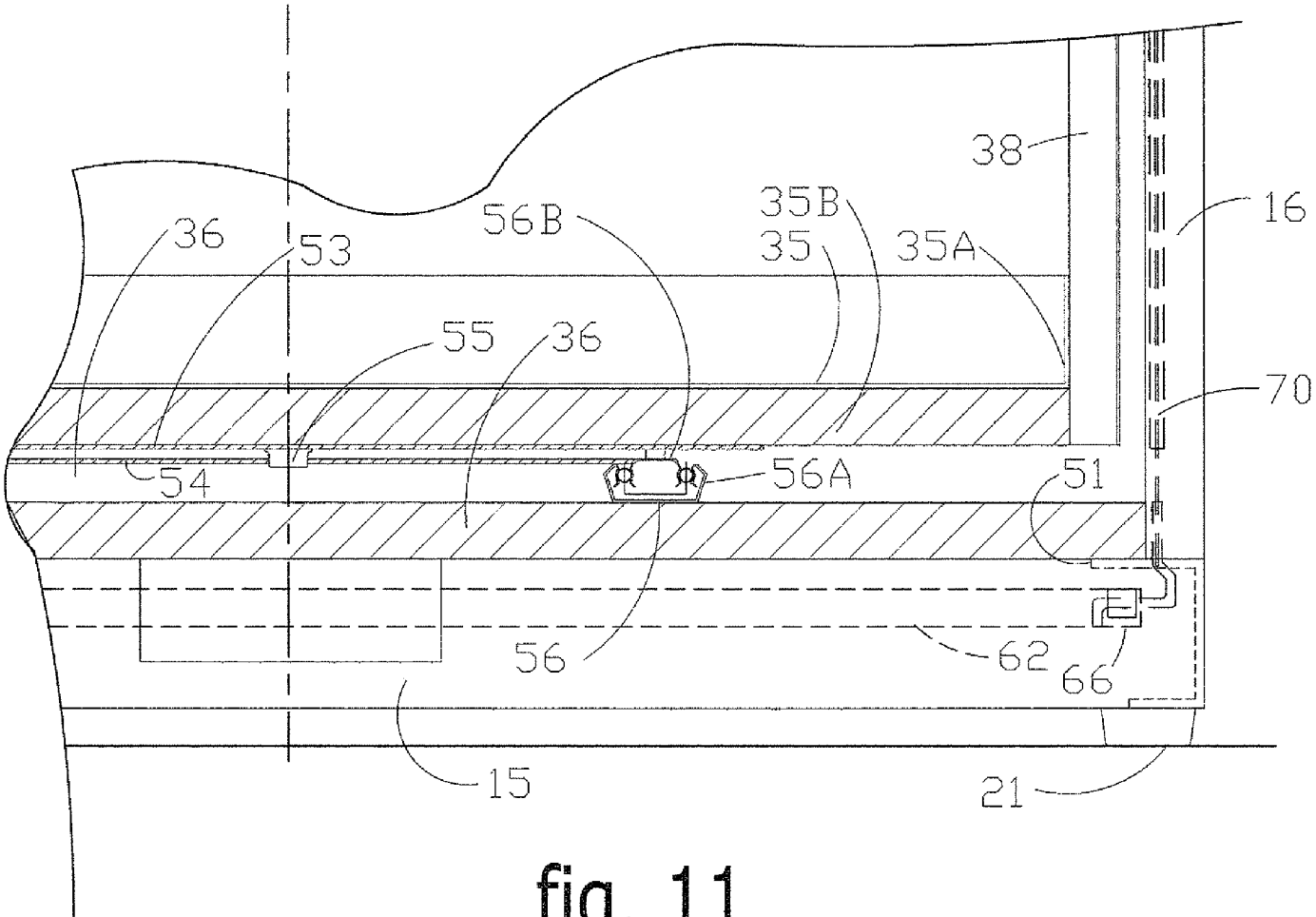
FIG. 11 is a sectional view taken on line 11-11 in FIG. 6.

The bottom pan 35 of the waste bag support frame 34 is rotatably supported on a rotating plate 53 of a suitable slidable and rotatable turn table assembly 52 (See FIG. 11).

The slidable and rotatable turntable assembly includes a pair of side tracks 56, 56. As shown in FIG. 11, the tracks 56 each include a base track portion 56A secured to the bottom wall 36 and a slidable track portion 56B that slides along the base track portion. The slidable track portions 56B have a slide plate 54 thereon. The plate 53 is rotatably mounted on the slide plate 54 with a swivel pin 55, and is secured to the bottom of the pan 35, which supports the waste bag support frame 34. The base slide plate 54 can slide from a position where the waste bag support frame 34 is retracted, as shown in FIG. 1, to a position where the waste bag support frame 34 is extended from the cabinet 12 as shown in FIGS. 3 and 4 for example, as well as in FIG. 12, for the second form of the disclosure. When extended from cabinet 12 the support frame 34 can be rotated 360 degrees. The slidable track portions 56B are mounted on suitable bearings for ease of sliding the base slide plate 54 in and out. The rotatable plate 53 can also be mounted on plate 54 with a thrust bearing that permits easy rotation of the waste bag support frame 360°.

To aid in moving the bag support or carrier frame 34 outwardly from the cabinet on the tracks 56, finger tabs 59 are secured (welded) to the ends 42A of the top plate 42. The tabs 59 are positioned so a person can insert a finger behind the tabs and pull the bag support frame outwardly.

The cover 24, which is a quarter of a sphere, is opened through the use of an actuator. As shown, a foot pedal actuator lever 60 is mounted to a cross shaft 62 which is pivotally mounted on pins 64 in the side wall base 15A. The foot pedal actuator lever 60 has a foot actuator pad 68. The lever 60 and the pad 68 extend out just beyond the exterior of the part cylindrical wall 38 when the waste bag support frame 34 is retracted relative to the cabinet and the foot pedal actuator is in its normal unactuated position.

The cross shaft 62 has an actuator arm 66 attached thereto which extends forwardly, and at the forward end of actuator arm 66

Figure 8:
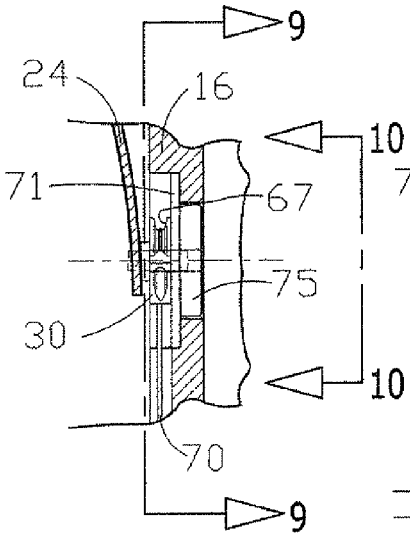
FIG. 8 is an enlarged front view of the pivot hinge assembly and damper for the cover for the receptacle.
Figure 9:
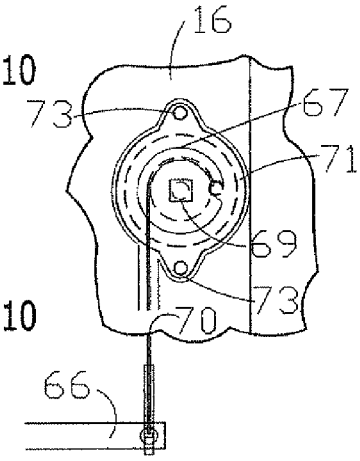
FIG. 9 is a fragmentary side view of the pivot hinge assembly for the receptacle taken on line 9-9 of FIG. 8.
Figure 10:
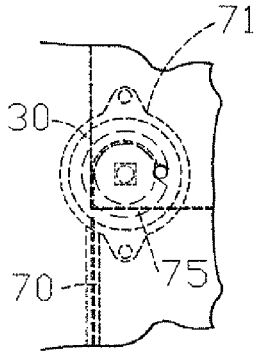
FIG. 10 is an end view of the pivot hinge and damper taken on line 10-10 in FIG. 8.

The depressed position of the foot pedal actuator 60 is shown in FIG. 1 in dotted lines, and when the foot pedal actuator 60 is moved to this position a cable 70 or other flexible line or member is attached and will be pulled down by downward movement of the actuator arm 66 as the actuator lever 60 is depressed. The cable 70 is on at least one side of the cabinet and connects to the outer circular periphery of a drive pulley 67 forming a part of the pivot support and damper mechanism 30 for the cover 24 (See FIGS. 8, 9 and 10). The cable 70 is in a track or guide and is wrapped partially around the periphery of the pulley 67 of pivot support and damper mechanism 30 when the cover 24 is closed and as the cable 70 is pulled down by the actuator arm by movement of the foot pedal actuator 60, the cable will rotate the pulley 67, which is coupled to the cover 24 with a shaft 69, so the cover is also rotated on its pivot as the pully is rotated. The pulley side may be directly attached to the cover with screws or a shaft that is drivably coupled to the cover may be used. The pulley has a shaft that is also mounted for rotation on a housing 71 of the pivot support and damper mechanism 30. The housing 71 is attached to the side wall 16 with screws or fasteners 73. The pulley shaft 69 is coupled to a damper element in an end housing 75 of the pivot support and damper mechanism 30 so the damper element is rotated in a first direction as the cover is opened and when the cover is closed, the damper element rotates in opposite direction and provides a damping function. The damper element damps cover movement in both direction of pivoting, When the foot pedal actuator 60 is depressed and the cover 24 is moved to its dotted line position, the top of the trash bag held by the ring 40 is easily accessible through the opening above the wall 38, and trash or waste can be dropped into the bag. The cover 24 will be held open with the latch 25 until the waste bag support frame is moved again to its retracted position with the waste bag back in the cabinet 12. Then, the latch 25 can be moved to let the cover 24 close.

It can be seen that if the bag support or carrier frame 34 is partially rotated when the frame 34 is retracted into the cabinet 12, the edge of wall 38 that first enters the cabinet will engage one of the bumpers 39, which will stop that leading edge and cause the wall 38 to rotate to its proper position as the frame 34 is further retracted into the cabinet.

The cover 24 may be manually moved from its open position toward the closed position and as it pivots closed, the center of gravity of the cover goes over center so the cover will continue to close under gravity. If the pivoting is undamped, the cover can close too fast. The pivot support and damper mechanism provides the damping action. A damper made by Sugatume is usable. The known damper element in the housing 75 of the pivot support and damper mechanism 30 provides a damping action as the cover closes, so it will close gently.

A spring that exerts force to urge the cover toward its closed position also can be provided to initially start the closing movement of the cover. The spring could be a torsion spring or a tension spring acting between the cover and the cabinet, and effective for only an initial movement of the cover from its open position, or until the cover center of gravity goes over center.

Figure 12:
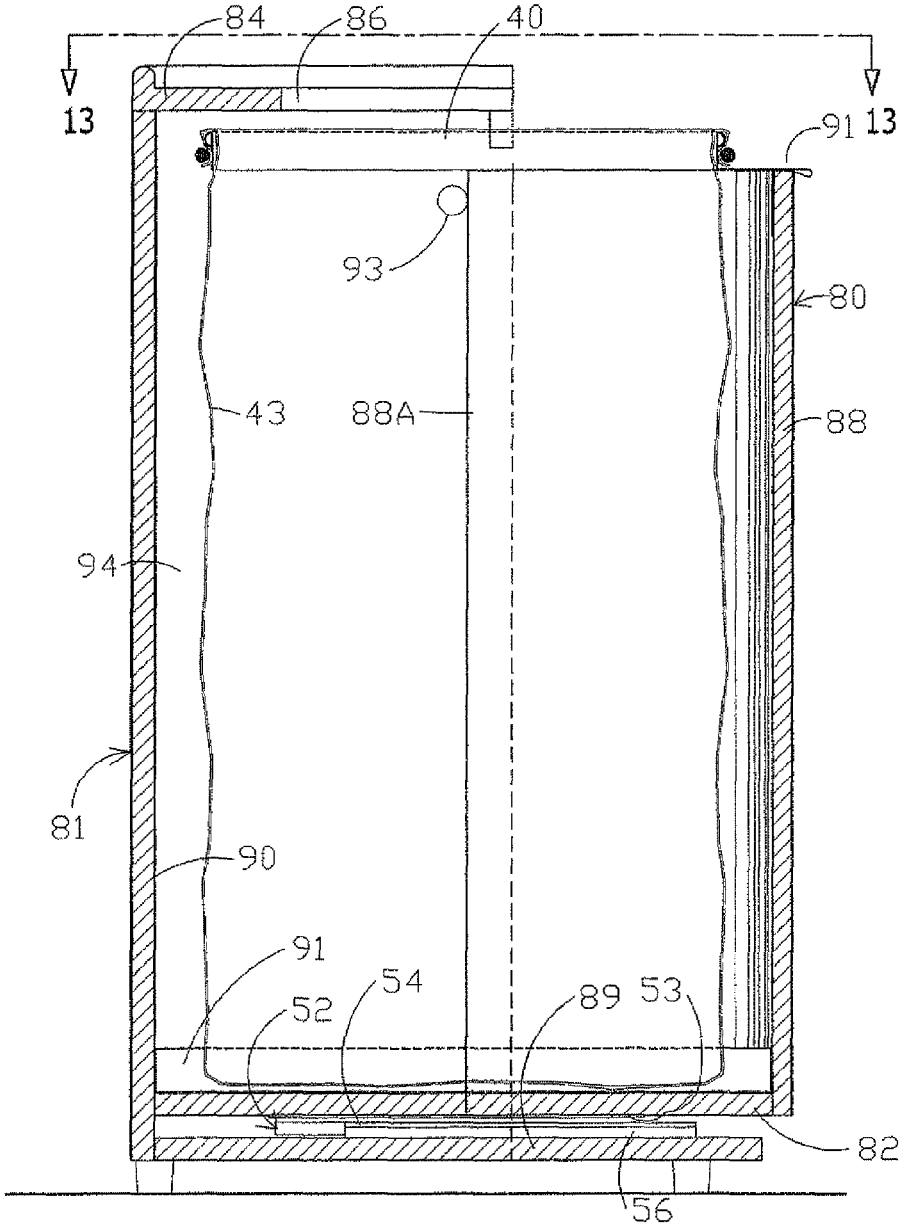
FIG. 12 is a vertical sectional view of a modified form of the waste receptacle, taken on line 12-12 in FIG. 13.
Figure 13:
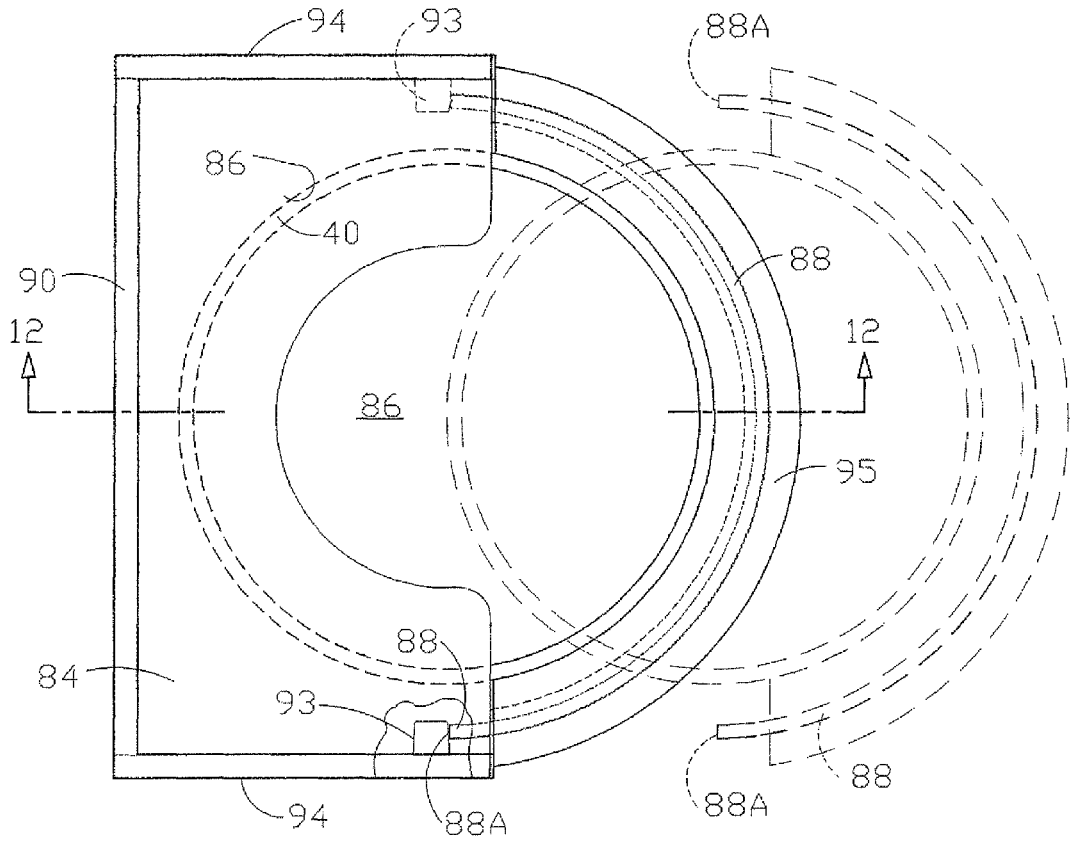
FIG. 13 is a sectional view taken on line 13-13 in FIG. 12.

In FIGS. 12 and 13, a modified form of the waste bag or receptacle support frame is illustrated at 80. The waste bag or receptacle support frame 80 is mounted in a cabinet 81 that is similar to the cabinet shown in the previous form, but the cabinet 81 does not include a top wall or the part spherical cover. The waste bag support frame 80 is mounted to move in and out of the cabinet 81, and includes a part cylindrical front wall 88 and a lower frame bottom or base support wall 82. The cabinet 81 has a rear wall 90, a side wall 94 and a bottom wall 89, which are supported on support feet. A slidable and rotatable turntable assembly 52 is mounted on bottom wall 89 so the arrangement is as disclosed in the first form of the disclosure. The slidable and rotatable plate 53 is secured to the bottom side of the frame bottom wall or base support wall 82 of the waste bag support frame 80. A pan 91 is mounted on top of the frame bottom wall 82, also in the manner shown in the first form of the disclosure.

The cabinet 81 is made similar to the previous form of the disclosure, but it includes a panel 84 near the top and above the ring 40 that is supported by the side and rear walls 94 and 90. The top panel 84 has a recess 86 so the bag support ring 40 and the top of a waste bag 43 supported on the ring 40 are exposed for depositing waste from above. The bag support ring 40 is secured to a top plate 95 (similar to the top plate 42) mounted on the top edge of the front wall 88, and extends as a part circular band around the part cylindrical front wall 88. The waste bag is supported on the bag support ring 40 in a suitable manner with the top open, as previously described.

Figure 6:
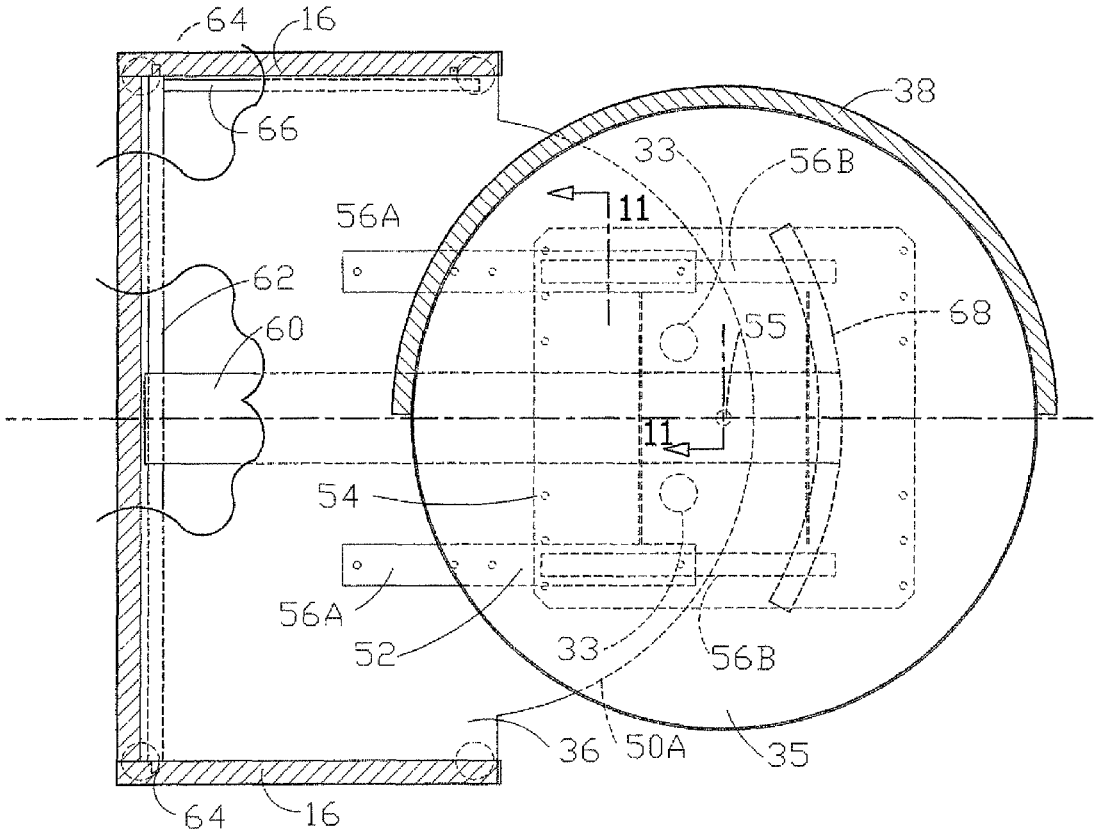
FIG. 6 is a sectional view taken as on line 6-6 in FIG. 3.

The turn table plate 53 is mounted for free rotation about an upright axis on the horizontally slidable base slide plate 54 that is mounted on tracks 56, constructed as shown in the first form of the disclosure. The front wall 88 and pan 91 can thus be slid, along with the ring 40 and supported bag, out of the cabinet 81 and rotated as shown in FIG. 6 for removing the full bag. The side walls 94 of the cabinet 81 and the edges 88A of the front wall 88 overlap. Bumpers 93 are secured to the side walls 94 and are of size to engage the edges 88A of the front wall 88 and will serve to position and stop the front wall 88 as the waste bag support frame is retracted into the cabinet, if the waste bag support frame is rotated slightly so one edge 88A leads the other as the waste bag support frame 80 is retracted.

Once a trash bag held by the ring 40 and the waste bag support frame 34 or 82 is full and needs to be emptied, the respective waste bag support frame is extended from the cabinet. In the first form of the disclosure shown in FIGS. 1-11, the foot pedal actuator 60 is depressed to open the cover 24 so the support frame and supported bag can be pulled out or extended from the cabinet. The bag support frame is then rotated so the full bag is exposed, for example as shown in FIG. 6, where the bag support frame has been rotated 90 degrees.

The top of the trash bag can be loosened from the support ring 40 and the top of the bag dropped below the ring. Then the bag can be slid off the bottom pan35 or 89 and removed without having to lift the loaded bag above the upper edge of an outer container. Lifting loaded waste or trash bags is required in conventional waste containers, and leads to strains and claims. A new bag can be installed, the bag support frame rotated back and the bag support frame retracted.

The pans 35 and 91 are made to catch liquids that may leak from a bag, as well as catch other debris that may fall alongside a bag held on ring 40. The pans can be of metal or plastic or other leak proof material.

Figure 14:
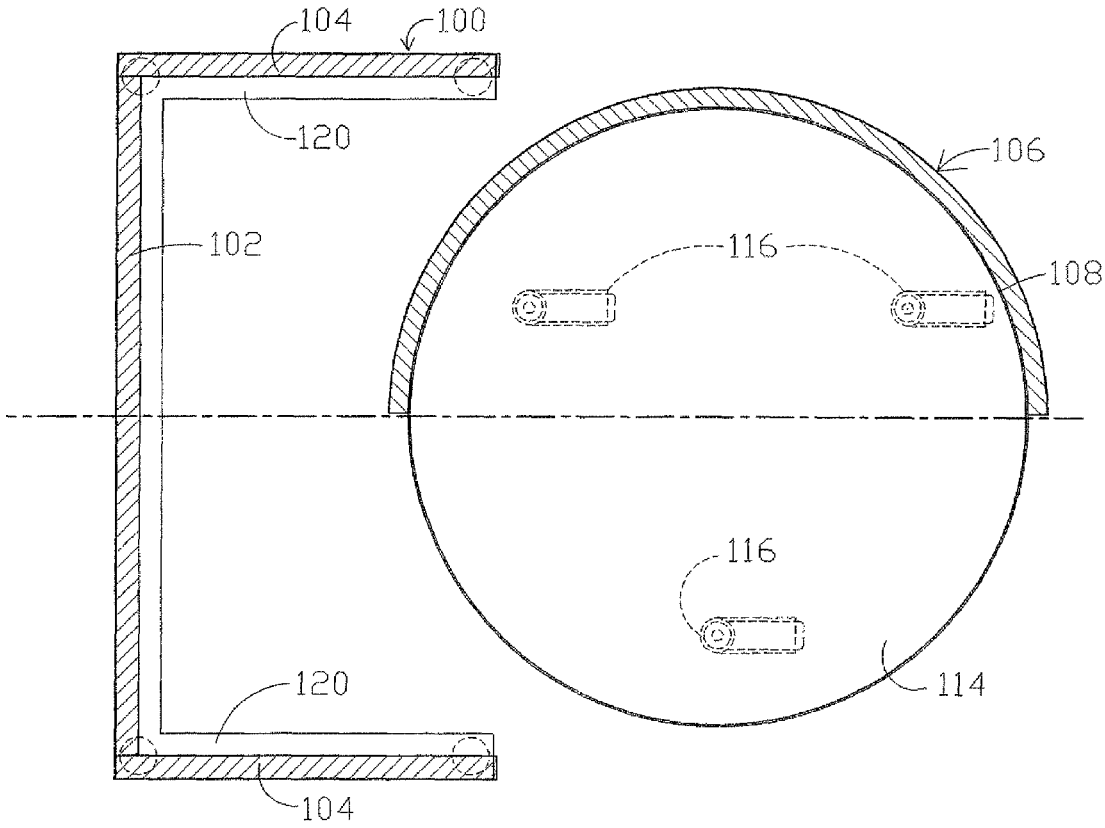
FIG. 14 is a top sectional view of a further modified form of the disclosure showing a waste bag support frame rotated 90° from a position where it would fit into a cabinet, and having casters for supporting the waste bag support frame taken generally on line 14-14 in FIG. 15.
Figure 15:
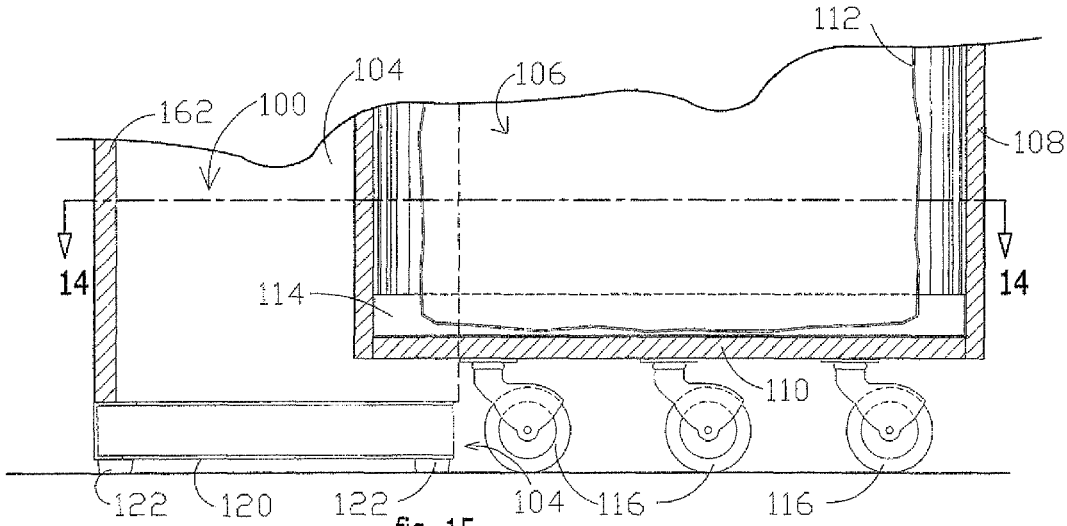
FIG. 15 is a fragmentary sectional view of the lower portion of the waste bag support frame of FIG. 14.

In FIGS. 14 and 15, a modified support for the waste receptacle is shown, and in this instance, the top portions of the waste receptacle can be made as previously shown, utilizing a support ring 40 for a trash bag and suitable supports for the ring. The cabinet illustrated at 100 is modified so that it is open sided and has a rear wall 102, and side walls 104 that are spaced apart and are of size to receive a waste bag support frame 106. The waste bag or receptacle support frame 106 includes a curved front wall 108 as previously shown, and a support or frame bottom wall 110. Again, the curved (part cylindrical) wall 108 has a suitable bag support ring at the upper end, so that a bag 112 can be supported above the frame bottom wall 110 as shown in FIG. 15.

The frame bottom wall 110 (FIG. 15) has a metal tray 114 supported thereon as previously shown. The bag 112 is suspended on the interior of the curved wall 108 and held in place.

The waste bag support frame 106 can be slid in and out of the cabinet 100 and rotated about an upright axis, as in the previous forms. The sliding and rotating support comprises plurality of swivel casters 116, as shown three casters, fastened to the bottom side of frame bottom wall 110 to support the waste receptacle for rolling movement along a supporting floor into and out of the opening of the cabinet 100. The casters also permit rotating the curved front wall 108 ninety degrees for easy removal of a filled waste bag.

It also should be noted that the cabinet 100 can have a channel-shaped rim support 120 that underlies the walls 102 and 104, and provides for sturdy support. Suitable glides or support feet 122 can be provided on the rim 120.

In this form of the disclosure, the waste bag support frame 106 can be rolled in and out of the cabinet and rotated 90° as shown in FIG. 14 (or more) for access to the trash bag held on the support ring 40. The trash receptacle can be moved in and out easily, and the curved wall mates with the side walls of the cabinet in the same manner as previously shown.

Figure 2:
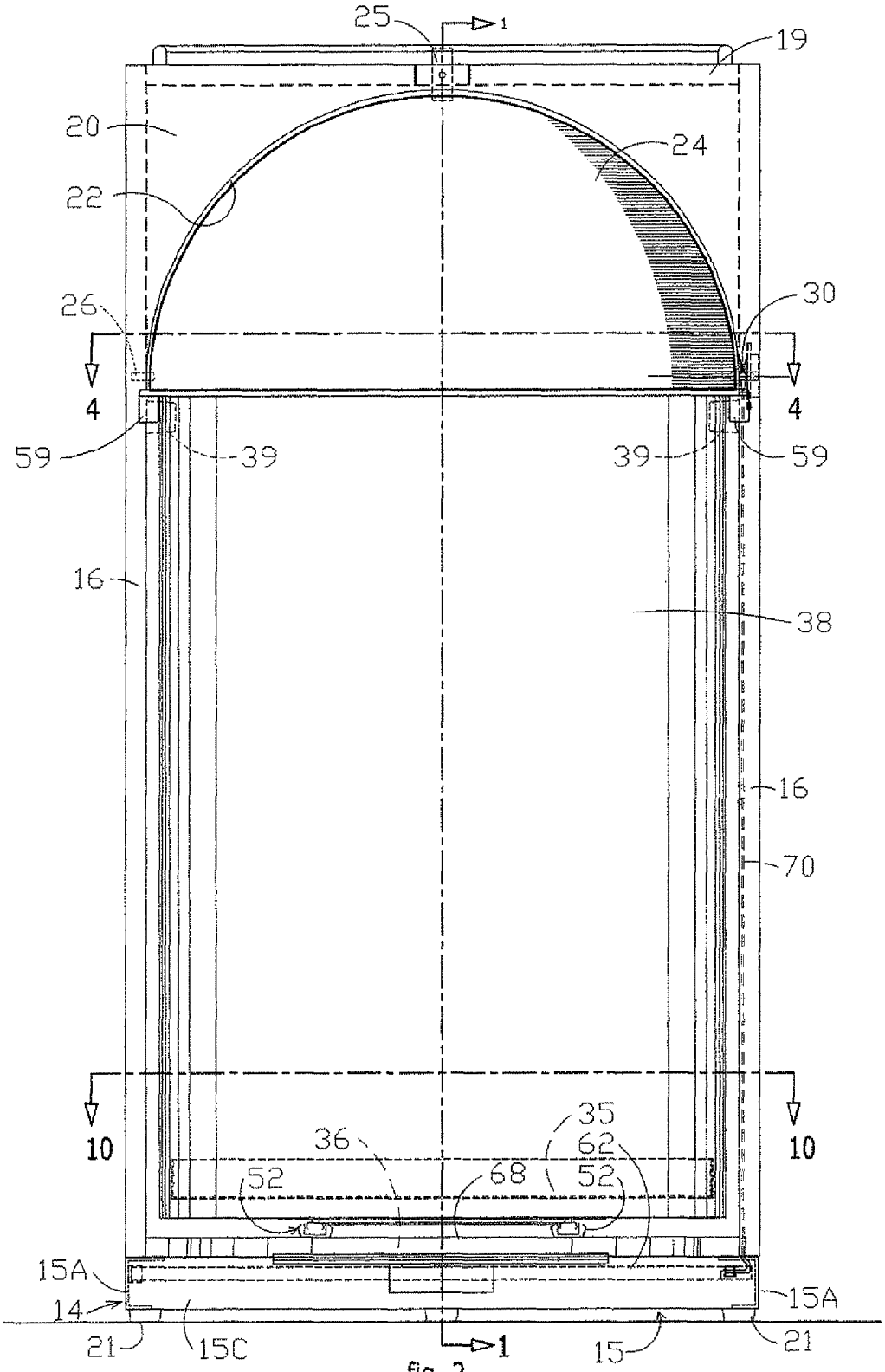
FIG. 2 is a front view of the waste receptacle of FIG. 1.

In FIGS. 16-19, a further modified form of the waste receptacle is illustrated, and the cabinet is constructed to be substantially similar to that shown in FIGS. 1 and 2. The waste bag or receptacle support frame indicated at 130 mounts on a swivel, and can be moved in and out of the cabinet between a retracted position and an extended position on tracks or slides. The extended position would substantially as that shown in FIG. 3, but in this form of the disclosure, there is no pivoting eyelid type cover. The waste bag support frame 130 includes a part cylindrical forward wall 132, a support wall 134 that is secured to the bottom of the part cylindrical wall as previously shown, and a leak-proof tray 136 is also provided.

Figure 16:
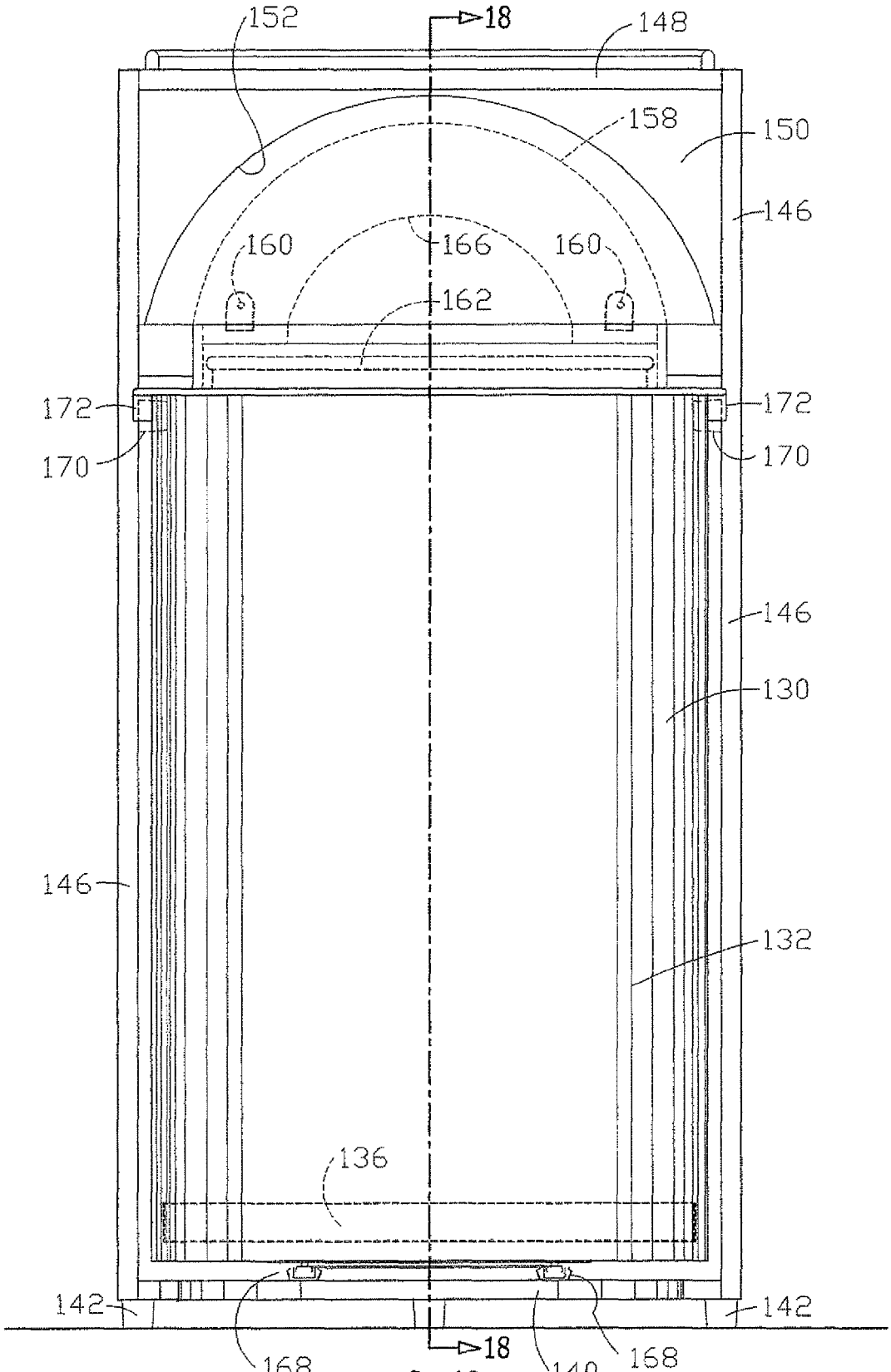
FIG. 16 is a front view of a modified waste receptacle and cabinet assembly.

The cabinet 138 in this form of the disclosure has a support frame or wall 140 mounted on suitable feet 142, and extends to join a back wall 144 and side walls 146. The back and side walls extend upwardly to a level above an upper end of the waste bag or receptacle frame 130, and the cabinet has a top or cover wall 148 supported between side walls 146 as shown in FIG. 16. A front panel 150 is provided, and has a part circular recess indicated at 152. In this form of disclosure, there is a horizontal shelf 154 secured between the side walls 148 which has a cut out opening 156 (see FIGS. 18 and 19). The horizontal shelf fits between the side walls 146 and terminates at forward edges of the side walls, and has a hinged cover portion 158 attached thereto with suitable recessed hinges shown at 160. Cover portion 158 will move from a position where it is substantially co-planar with the shelf 154, and wherein it overlies the waste bag or receptacle frame 130, to a position shown in dotted lines and arrows in FIGS. 17 and 18 where it overlies the shelf and leaves a portion of the top part of the waste bag or receptacle frame exposed so that material can be dropped into the waste bag supported on the hoop or ring that is shown at 162. The ring 162 is supported on a top plate 163.

A part circular flange 164 is formed around the cover 158 to shield the ring 162 and the top part of the waste bag. The cover 158 has an open portion or cutaway 166, as well, so that with the opening 156 and the shelf 154 and the opening 166 on the cover, there is an opening into which a person can drop trash through the opening formed by recess 152 in the front panel 150. The waste bag or receptacle frame 130 is mounted on slides or tracks 168 which are the same construction as the slide or tracks 156 shown in FIGS. 1-3. The waste bag or receptacle frame can be slid outwardly from the cabinet for access for replacing bags and the like on the ring 162.

Figure 17:
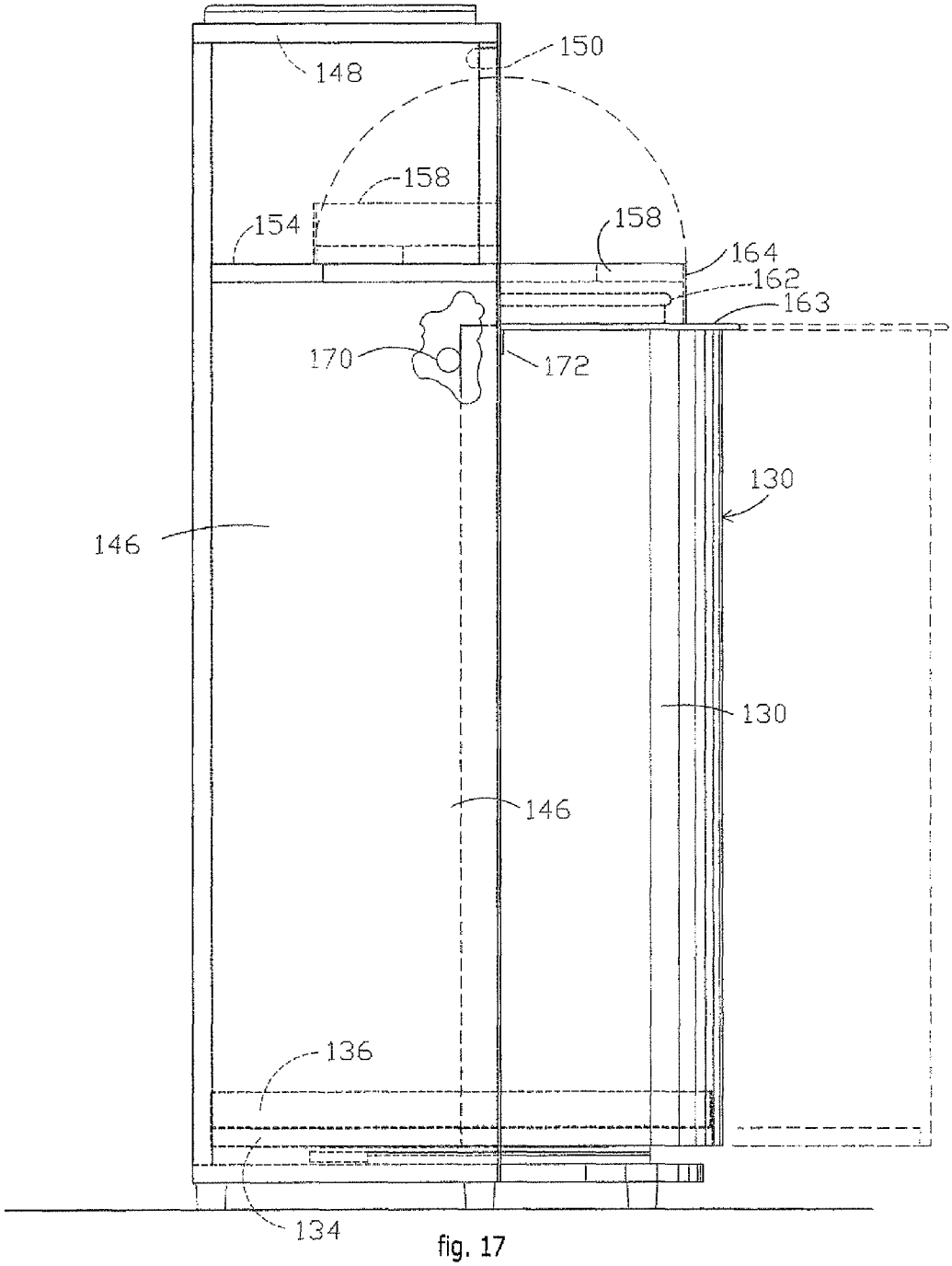
FIG. 17 is a side plan view of the form of the waste receptacle shown at FIG. 16 with parts broken away.
Figure 18:
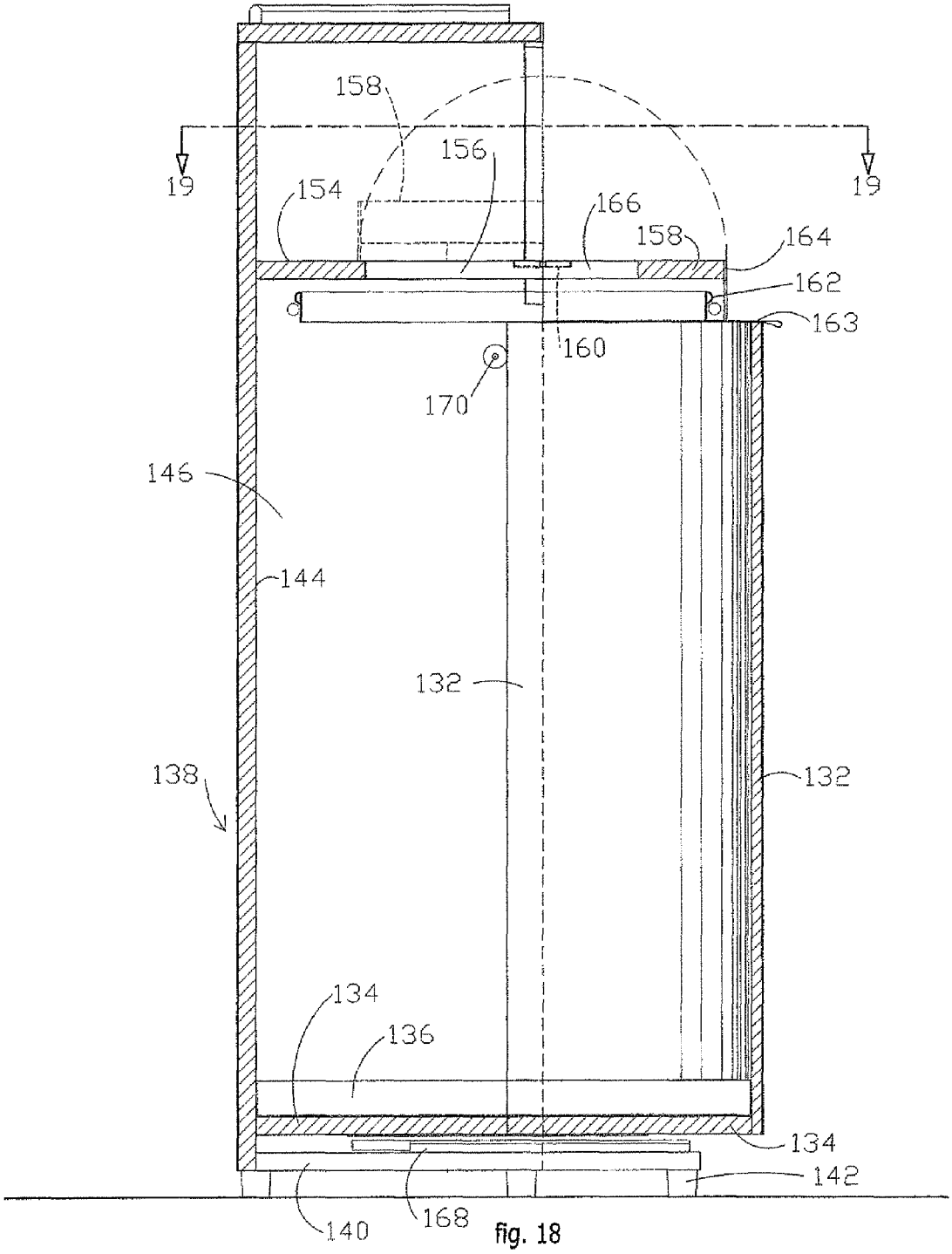
FIG. 18 is a sectional view taken on line 18-18 in FIG. 16.
Figure 19:
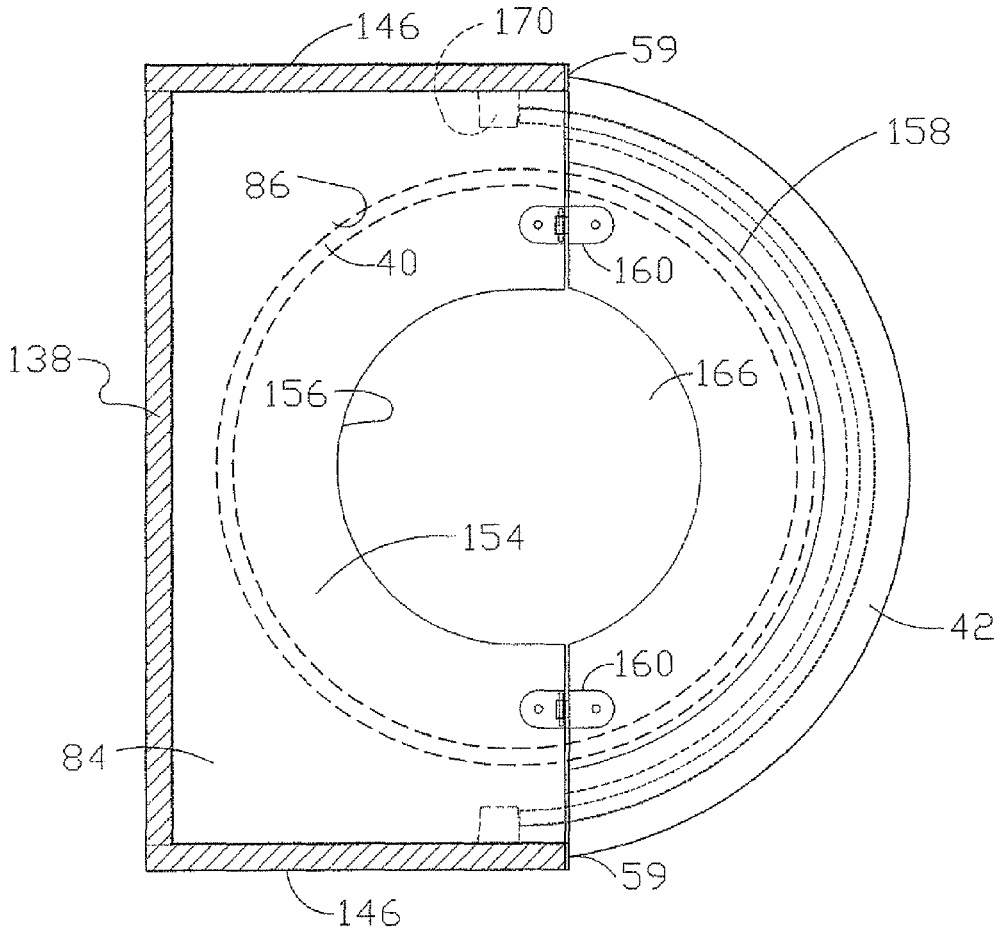
FIG. 19 is a sectional view taken on line 19-19 in FIG. 18.

In FIG. 17, one of the side walls 146, is cut away to show a bumper 170 at the rear end of the part cylindrical wall 132, as previously shown, which will engage rear edges of the wall 132 to maintain the wall 12 properly oriented as it is retracted. There is one of those bumpers 170 on each of the side walls 146.

Also, the flange 163 has finger tabs 172 mounted on the rear edges of the top plate 163. A finger of an operator can be slid behind the tabs 172 to pull a waste receptacle out. The finger tabs 172 can be mounted at any suitable manner, and can be welded to the top plate 163. The finger tabs 172 are positioned so that a finger can get behind them for pulling the waste receptacle out of the cabinet.

Figure 20:
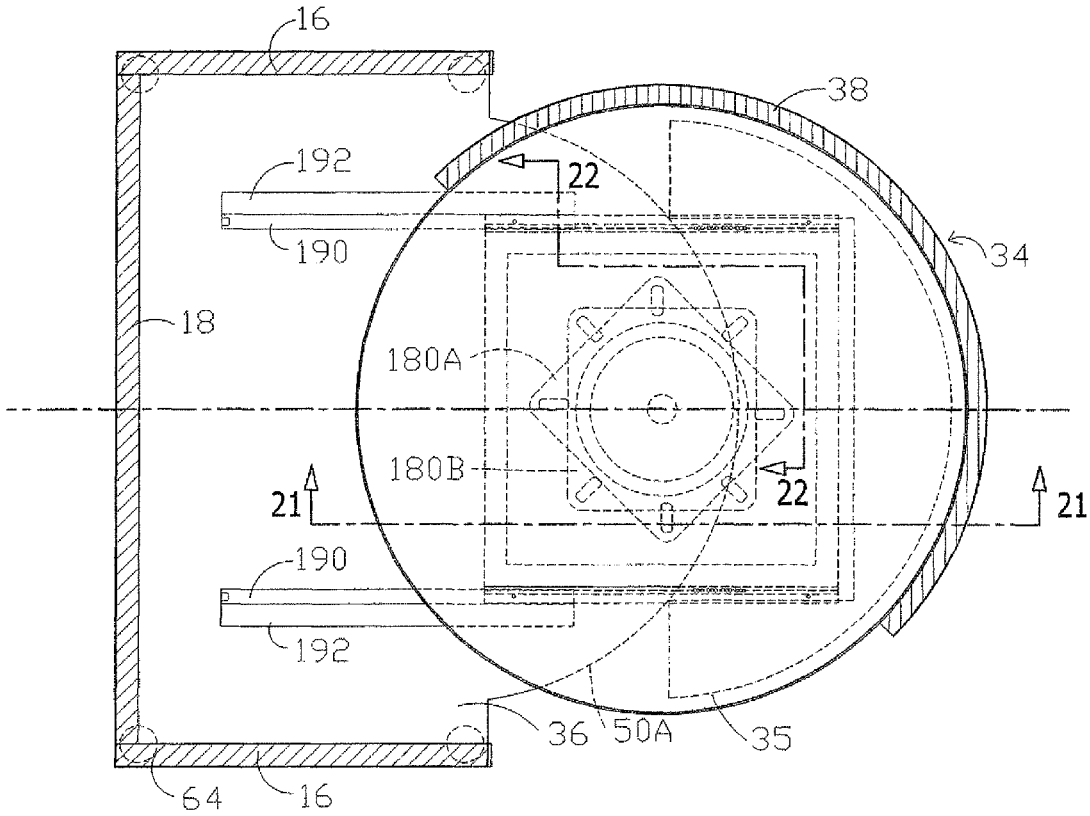
FIG. 20 is a sectional view of the lower portion of a waste bag support frame taken on a line similar to FIG. 6, but with a modified slide and turntable assembly.
Figure 21:
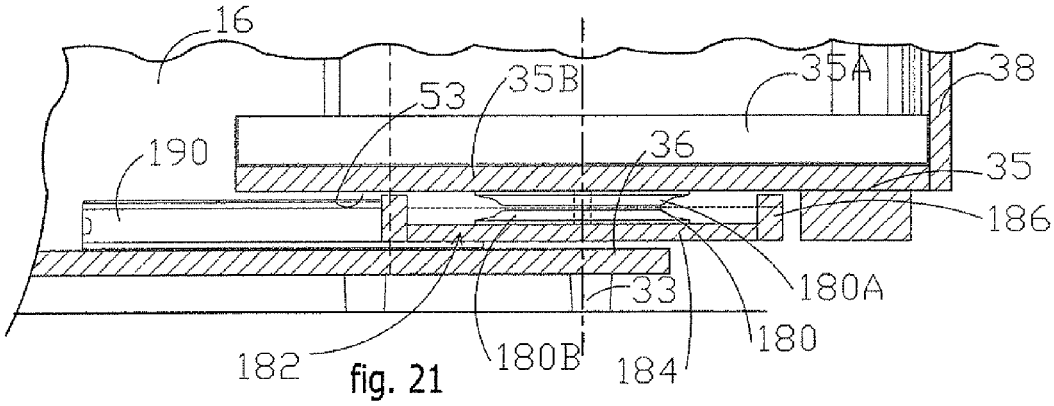
FIG. 21 is a sectional view as on line 21-21 in FIG. 20, with a waste bag support frame retracted.
Figure 22:
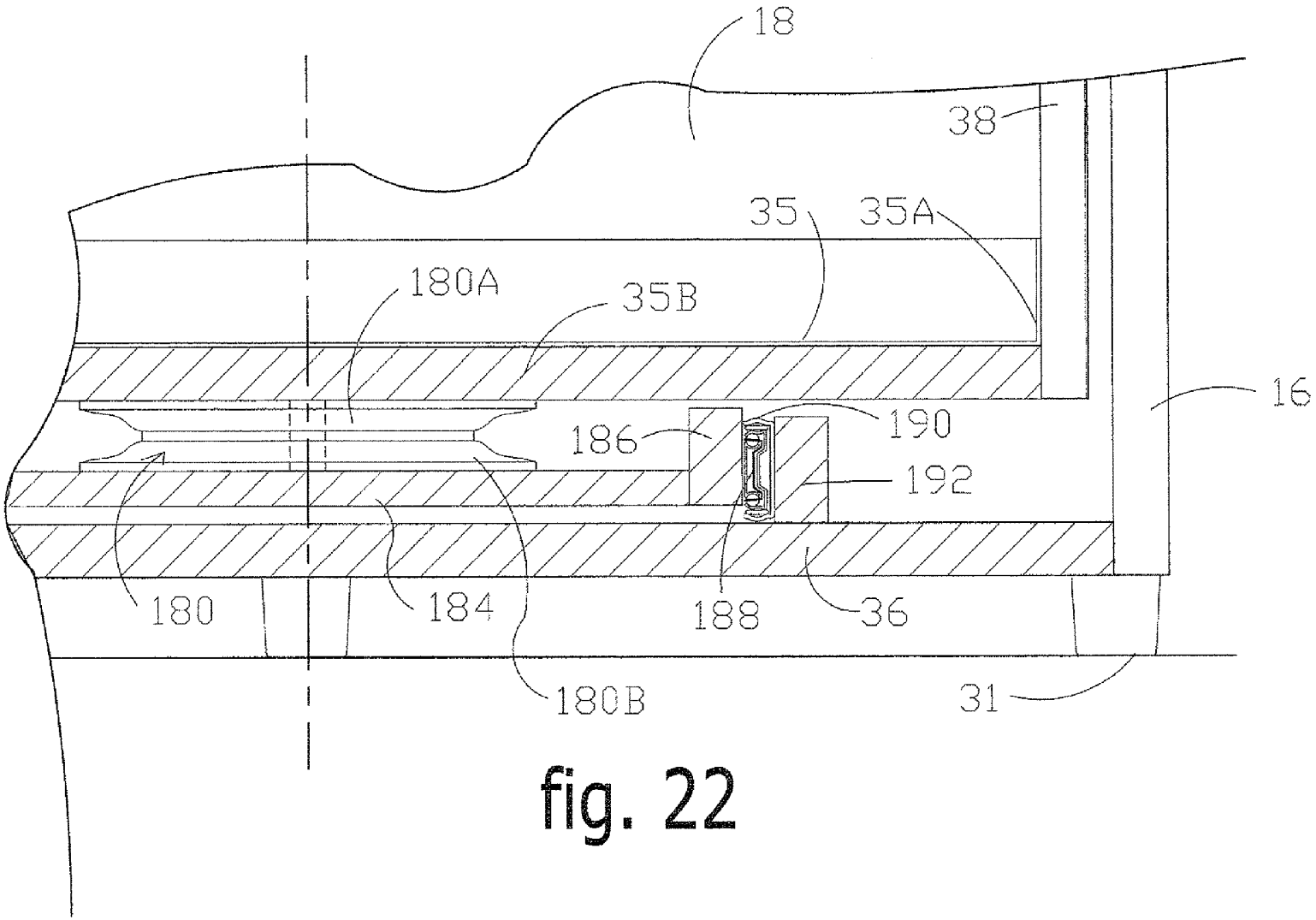
FIG. 22 is a sectional view taken on line 22-22 in FIG. 20, with a waste bag support frame retracted.

FIGS. 20, 21 and 22 disclose a different assembly for the slide and the turntable. This construction can be used in place of the slide and turntable shown in FIG. 6 for example. FIG. 20 is similar to FIG. 6, and the same cabinet construction can be utilized. The same construction of the waste bag or receptacle frame can also be utilized, and the numbers in FIGS. 20, 21 and 22, that are the same as in the previous figures, show essentially the same parts.

The illustrations of FIGS. 20, 21 and 22 are where the waste bag or receptacle support frame does not have the removable lid, and the associated mechanism.

In FIG. 20, the frame bottom or support wall 35B of the waste bag support frame 34 is supported on a bar stool swivel assembly indicated at 180, The bar stool swivel assembly 180 includes a top portion 180A secured to the panel 35B and a lower portion 180B that is secured to an attachment frame 182 that includes a support wall 184 on which the lower portion 180B of the swivel 180 is mounted. The top portion 180A swivels relative to the lower portion 180B. A pair of side rails 186 that are fixed to the sides of the support wall 184 in turn support sliders 188 mounted in tracks 190 that are supported on upright guides or walls 192. The sliders 188 and the tracks 190 are drawer slides used conventionally for pull out drawers, and the side rails 186 are provided so that the slides 188 can be easily attached in place.

It can be seen that the panel 35B clears the side rails 186, so that it is free to be rotated utilizing the swivel 180.

The barstool swivels are available from Hardware Distributors, Limited, and the drawer slides are available from hardware suppliers such as Knapp & Vogt Manufacturing Company of Grand Rapids, Mich. USA.

In all forms of the disclosure, the waste bag is supported on a waste bag support frame that mates with and is movable partial into the cabinet. The waste bag support frame has a front wall that closes the cabinet front and the waste bag support frame can be moved out of the cabinet and rotated for ease of removing a loaded waste bag. The waste bag is easily attached and held in place and easily removed.

The curved front wall nest with the cabinet and forms a pleasing appearance. The cover shown is also easily operated and covers the opening to the trash bag when closed.

Figure 23:
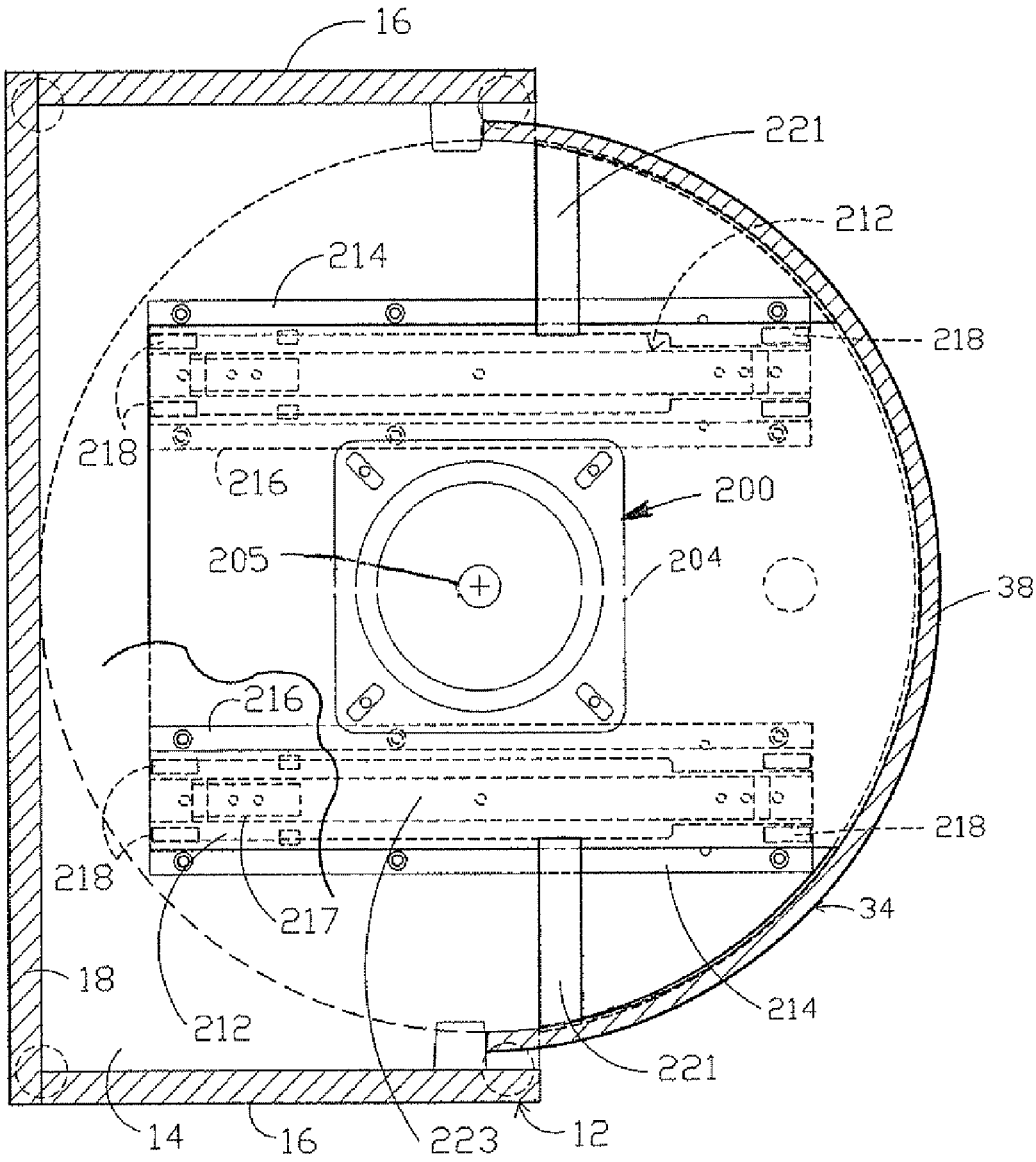
FIG. 23 is a top plan view of a further modified form of the waste receptacle support track and swivel.
Figure 24:
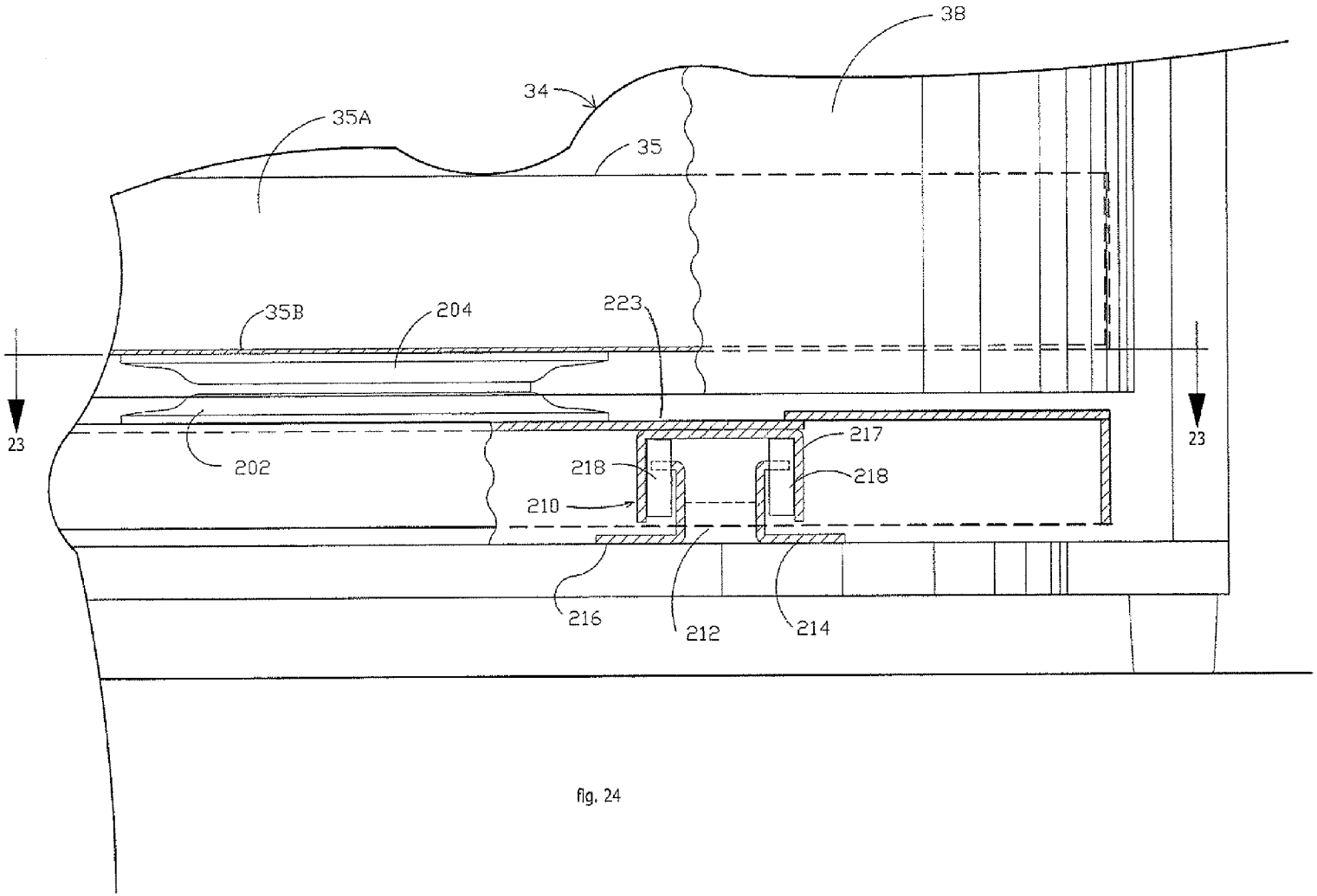
FIG. 24 is an enlarged front sectional view of the support of FIG. 23.
Figure 25:
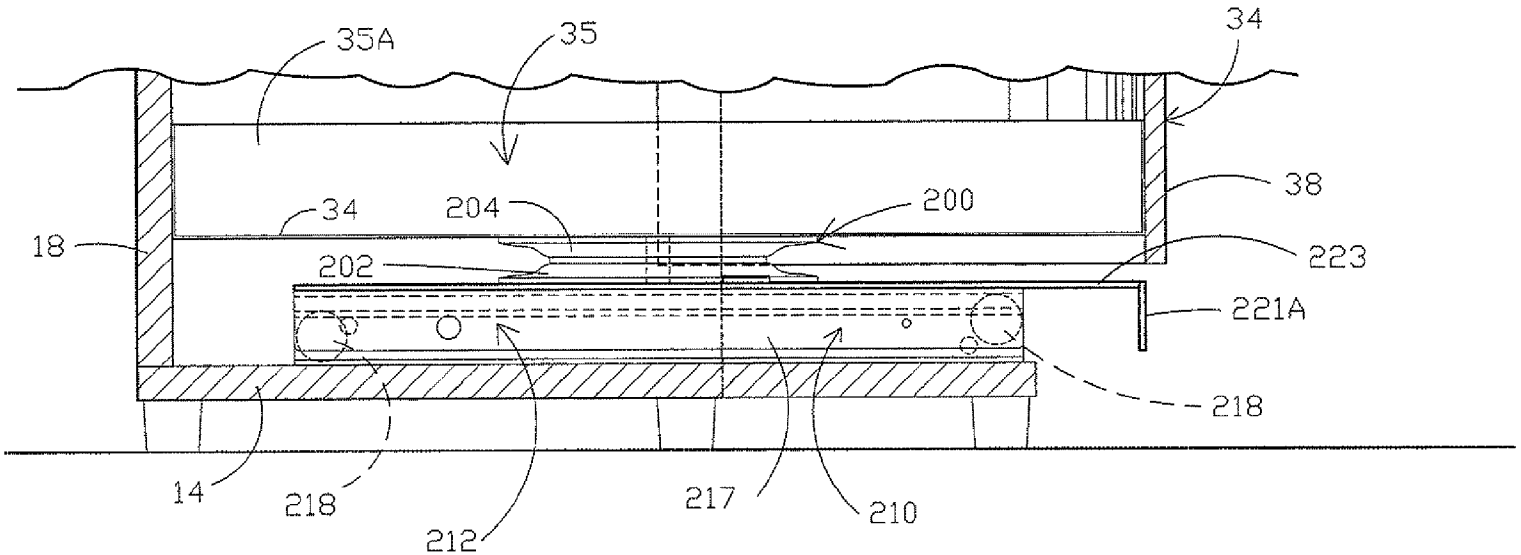
FIG. 25 is a side view of the support track and swivel of FIG. 23.

In FIGS. 23-25, a modified support for the waste receptacle is shown, with increased load carrying capacities. Portions of the waste receptacle can be as previously shown, and utilizing a support ring for the trash bag and suitable supports for the ring. The cabinet as previously shown, is indicated 12. The cabinet includes side walls 16, a base wall 14, and a rear wall 18 as constructed, but can take different configurations if desired. The waste bag support frame is indicated at 34 as in previous forms of the invention, and the waste bag support frame includes a metal base pan 35 that has a peripheral wall 35A and a bottom wall 35B, which can be fastened directly to the swivel assembly 200 shown in the this form of the invention. The base pan 34 can be made of sufficient strength so that it will support the forward curved wall 38. The swivel assembly 200 is a purchased assembly, as in the previous forms of the invention, that is a high load carrying device, that will support the load of a large trash bag carried on the support ring at the top of the waste bag support frame 34, with adequate strength.

A modified, heavy duty slide assembly indicated at 210 is supported on the bottom wall 14 of the cabinet, and includes base tracks 212, which as shown each comprise a pair of longitudinally extending rails 214 and 216, that are spaced apart. The rails 214 and 216 each support rotatably mounted rollers 218. These rollers 218 are at the forward and rear ends of the slide assembly 210, as shown in FIG. 23. The rollers 218 are independently rotatably mounted, and can be made of low friction material and of suitable strength.

The slide assembly 210 further includes a pair of inverted track slider channels 217 and 219, respectively, which are mounted onto a support plate 223 that spans the channels and extends fore and aft along the length of the inverted channels 217 and 219. There are support straps 221 attached to the sides of the support plate 223 to support a flange 222 that is also supported on the front of plate 223. The swivel 200 has two portions or sections, including a bottom half portion 202 secured to support plate 223, and top half portion 204 which is secured to the metal base pan 35. The two swivel portions 202 and 204 are supported relative to each other on a ring of suitable ball bearings, in a normal manner, and a center post 205 holds the two swivel portions 202 and 204 so that they can rotate relative to each other. The support plate 223 thus will move along with the inverted channel track sliders 220 and 222 on the rotatable rollers 218 in a fore and aft direction, and the swivel 200 permits rotating the bag holder. Suitable stops and orienting bumpers can be provided for stopping the sliding movement in and out of the waste bag support frame 34.

In this form of the slide and swivel, the waste bag support frame 34 and any waste bag carried by the support frame are supported on eight individually mounted rollers or wheels, with sturdy supports for the rollers, and heavy duty inverted channel track sliders held together with a sturdy support plate 223. This provides for a very rugged swivel and slide assembly.

Figure 26:
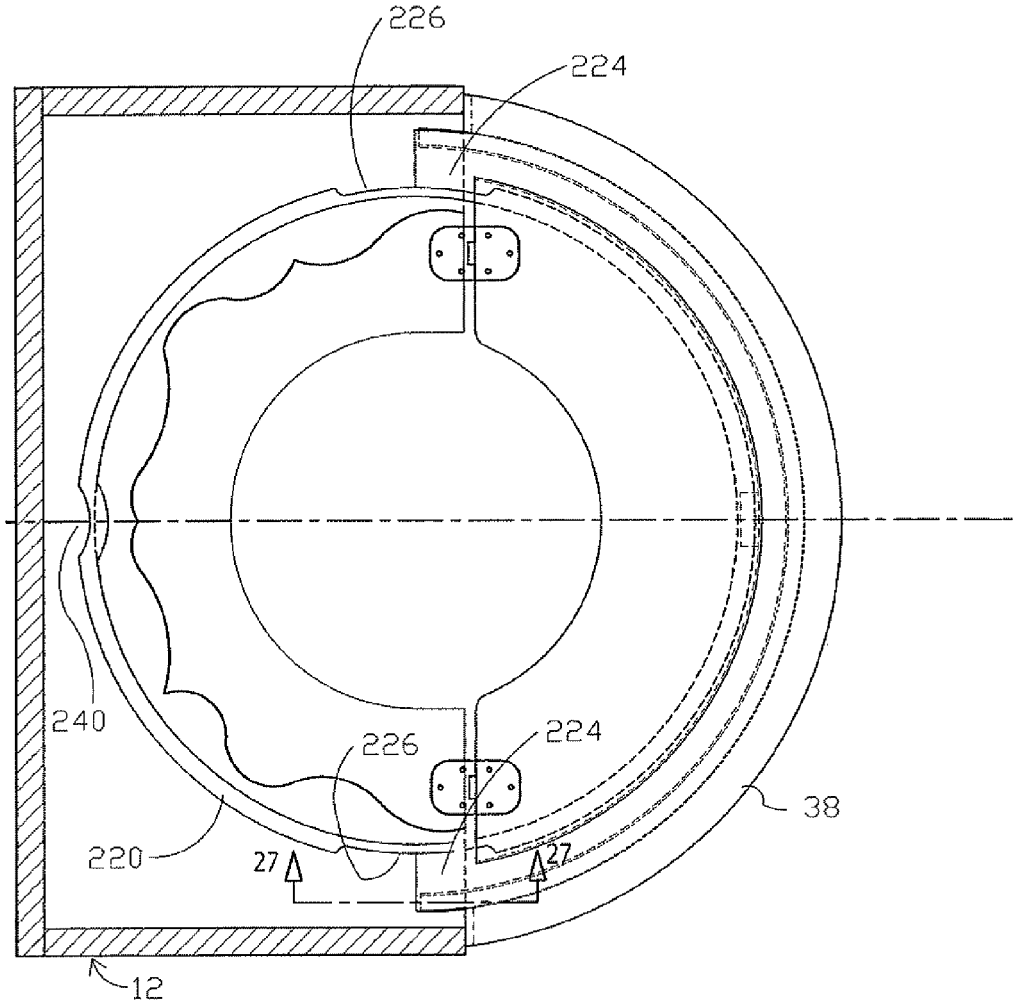
FIG. 26 is a plan view of a waste receptacle support ring having modifications for insuring secure retention of a plastic waste bag.
Figure 28:
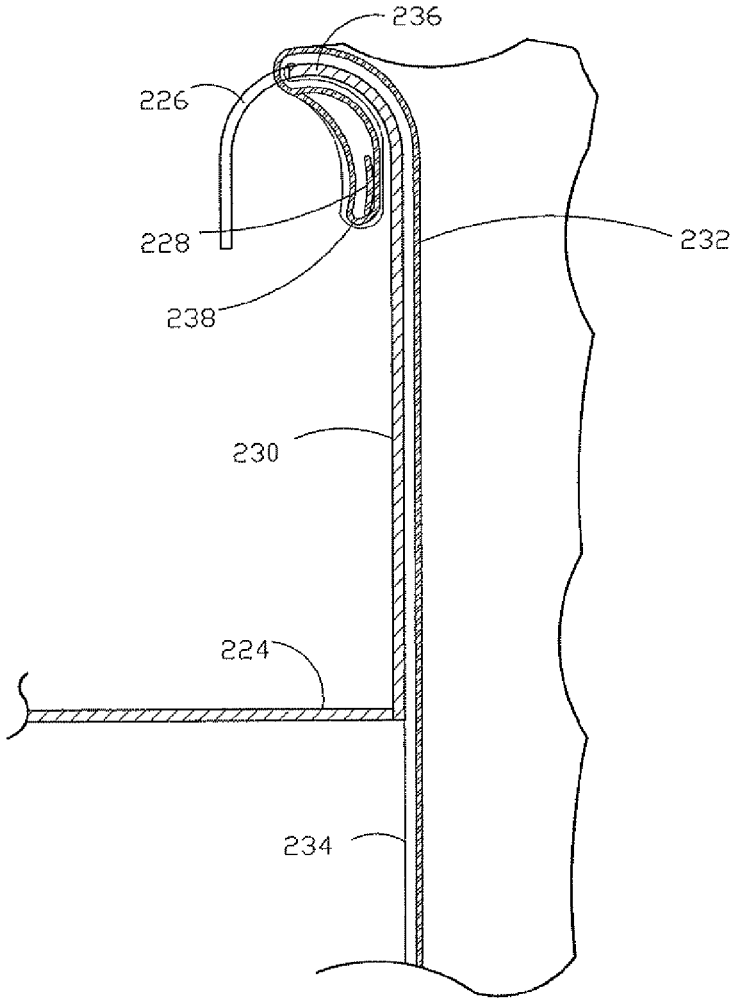
FIG. 28 is an enlarged sectional view taken on line 28-28 in FIG. 27.
Figure 27:
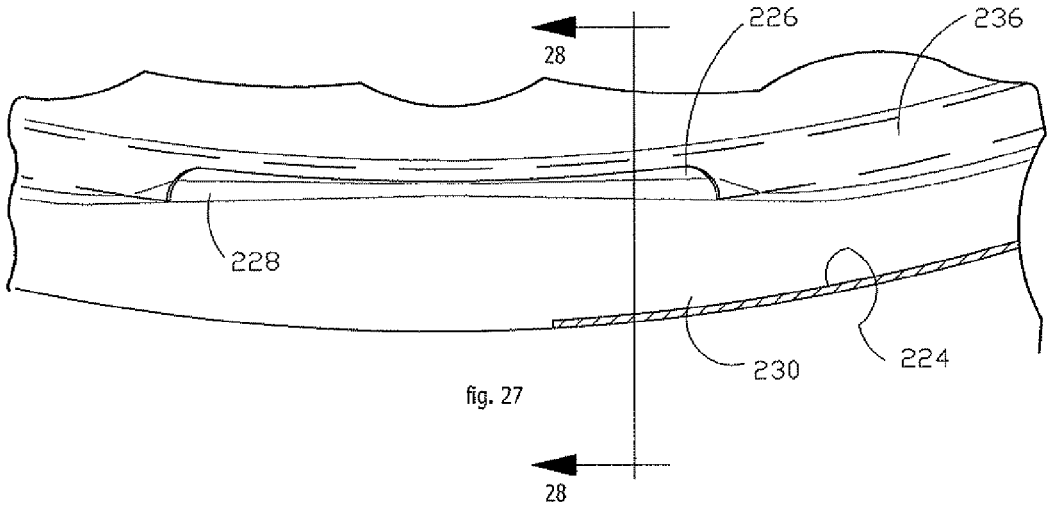
FIG. 27 is a sectional view taken on line 27-27 showing a recess in the modified waste receptacle support ring.

FIGS. 26, 27 and 28 show a modified waste or trash bag support ring 220 that takes the place of the bag support ring 40. It can be mounted in any suitable manner, but in this instance, there is a support wall 222 in place on the front wall 38, and a mounting flange 224 is welded to a peripheral upright wall 230 of the ring 220 and the flange is attached suitably to the front wall 38 for supporting the ring in place.

This bag support ring 220 is made so that a trash bag 232 will be securely held with a drawstring tie around the ring. Trash bags are made with seams 234 vertically or along the height of the bag on the outside of the bag and 180° apart. In other words, there are two seams 234 on each bag, and in a ring that is continuously curved, the seams may cause the bag to ride up around the rim, and not be securely held in place as the weight of trash inside the bag increases.

In this form of the ring 220, there are notches 226 made within the rolled top portion 236 of the ring on each side of the ring. The notches 226 are 180° apart, and as can be seen in FIG. 27 for example, a drawstring which is indicated at 228 (with no bag shown) will be drawn toward the side of the upright peripheral wall portion 230 of the ring, and will pull the trash bag in tightly around the ring in the regions where the bag seam or rib is made.

Referring to FIG. 28, in large detail and schematically, the trash bag 232 which can be formed as previously shown, is illustrated with a seam 234 on the outside of the bag, coming up around the ring peripheral wall portion 230 and around the rolled top portion 236, and the drawstring or ribbon 228 is shown enclosed in a pocket 238 formed in the upper portions of each trash bag.

It can be seen that the pocket portion of the trash bag and the rib or seam 234, are pulled tightly in against the upright wall portion 230 of the support ring 220, to ensure that the bag will be locked tightly in place.

Again, the notches 226 are 180° apart, and greatly aid in the trash bags, such as that shown at 232 in position.

The ring 220 also has an inset portion, shown as a recess 240, on the rear side, opposite from the curved front wall 38, which is of size to permit a person to more easily grasp a portion of the bag wrapped over the rolled top portion 236, the drawstring and drawstring pocket of the trash bag 232 for ease of removal. The bag 232 can be rotated 180° from its position shown in FIG. 26 when the bag is to be removed, and this inset or recess 240 provides a place for grasping the wrapped portion and the drawstring, which span the recess. The upright cylindrical wall portion 230 of the ring will be recessed also at recess 240 and the bag top portion and drawstring will span across the recess 240 for ease of grasping.

Although the present invention has been described with reference to preferred embodiments, workers skilled in the art will recognize that changes may be made in form and detail without departing from the spirit and scope of the invention.

What is claimed is:

1. A waste receptacle comprising a cabinet having an open front;

a waste bag support frame having a front wall that terminates to form a rear opening, and sized to fit at least partially within the cabinet when in a first retracted position;

a frame support for mounting the waste bag support frame relative to the cabinet, including a linear slide on the cabinet for linearly movably mounting the waste bag support frame relative to the cabinet, and a rotatable support mounted on the linear slide and supporting the waste bag support frame for rotatable movement;

a ring attached to the front wall of the waste bag support frame and having a portion extending rearwardly of the front wall of the waste bag support frame and spaced upwardly from a lower end of the waste bag support frame to provide space for a waste bag below the ring and above the lower end of the waste bag support frame accessible through the rear opening of the waste bag support frame, the ring being adapted to support an upper end of a waste bag with such a waste bag in the space, and the waste bag support frame being linearly movable with the linear slide to a second position where the waste bag support frame is extending from the cabinet and the waste bag support frame is rotatable on the rotatable support to place the ring and a waste bag supported thereon to an exterior of the cabinet to provide access when rotated in the second position to the rear opening of the waste bag support frame for removal of a waste bag below the ring.

2. The waste receptacle of claim 1 wherein the rotatable support comprises a turntable supported on the linear slide for rotatably supporting the waste bag support frame relative to the linear slide.

3. The waste receptacle of claim 2, wherein the waste bag support frame comprises a frame bottom wall supported on the turntable, and the front wall being secured to the frame bottom wall and extending upwardly therefrom, said front wall being part cylindrical and being to the exterior of the cabinet when the waste bag support frame is in the second position.

4. The waste receptacle of claim 3 wherein the ring is generally circular, and has a diameter less than a transverse distance between edges of the front wall, the ring having a rolled upper edge around which an upper portion of a waste bag can be wrapped for support.

5. The waste receptacle of claim 4 wherein the ring includes a peripheral wall supporting the rolled upper edge, the rolled upper edge extending outwardly from the peripheral wall, and a pair of notches in the rolled upper edge such that an edge of a waste bag wrapped over the rolled upper edge can be drawn into the notches with a drawstring around the peripheral wall.

6. The waste receptacle of claim 1, and a cover pivotally mounted to the cabinet about a generally horizontal axis, said cover being movable from a closed position wherein the cover has an edge that overlies the front wall of the waste bag support frame, to an open position wherein the cover edge moves upwardly about the horizontal axis and the cover is substantially within the cabinet, and an actuator for moving the cover from the closed position to the open position.

7. The waste receptacle of claim 6, wherein said actuator comprises a foot pedal actuator having an actuator arm connected thereto, a pivot connection on the cover having a circular periphery, and a flexible member between the pivot connection and the arm of the foot pedal actuator, the flexible member being partially wrapped around the periphery of the pivot connection when the cover is in a closed position, the foot pedal actuator being connected to the flexible member and in a first position when the cover is in the closed position, and the foot pedal actuator being operable to move to a second position to cause the arm to move and cause the flexible member to rotate the pivot connection to move the cover to the open position.

8. The waste receptacle of claim 7 wherein said front wall of the bag support frame is part cylindrical, and the cover comprises a part spherical cover having an edge that overlies and mates with an upper edge of the front wall of the wste bag support frame when the cover is in a closed position.

9. The waste receptacle of claim 6 wherein said actuator comprises a foot pedal actuator pivotally mounted to the cabinet and having an actuator arm connected to pivot the cover to the open position when a portion of the foot pedal actuator is depressed.

10. The waste receptacle of claim 1 wherein the cabinet includes a shelf supported above a rear portion of the ring, and a cover hingedly connected to the shelf and movable from a first cover position overlying a front portion of the waste bag support frame to a second cover position overlying the shelf, the shelf and cover having recesses forming an opening above center portions of the ring.

11. A waste receptacle comprising a cabinet, a bag support frame movable from a first position wherein a portion of the bag support frame is within the cabinet, to a second position wherein the bag support frame extends from the cabinet, the bag support frame being rotatable about an upright axis relative to the cabinet in the second position, said bag support frame having a frame bottom, and a front upright wall supported on the frame bottom, a ring mounted on the front upright wall spaced above the frame bottom to permit a waste bag to be supported on the ring and extend downwardly toward the frame bottom, the bag support frame being unobstructed below the ring and above the frame bottom in a direction away from the front wall to permit removal of a filled waste bag under the ring, said bag support frame and front upright wall being movable outwardly from the cabinet to the second position, and in the second position a waste bag supported on the ring being substantially on an exterior of the cabinet and such a waste bag being removable through a space below the ring and above the frame bottom in a direction away from the front wall.

12. The waste receptacle of claim 11, wherein the cabinet has a cabinet bottom wall, the bag support frame being supported relative to the cabinet bottom wall on a linear slide, and a rotating coupling between the linear slide and the bag support frame mounting the bag support frame for rotation about an upright axis.

13. The waste receptacle of claim 11, wherein said frame bottom comprises a shallow pan having a peripheral wall of height to not substantially obstruct a space between the ring and the frame bottom, and wherein said front upright wall is part circular in cross section and has side edges and is attached to the peripheral wall of the pan, the side edges being adjacent forward edges of the cabinet when the bag support frame is in the first position.

14. The waste receptacle of claim 13, wherein the cabinet has spaced side walls between which the side edges of the front upright wall fit when the bag support frame is in the first position, and bumpers secured to the side walls of the cabinet and positioned to be engaged by the side edges of the front upright wall when the bag support frame is in the first position.

15. The waste receptacle of claim 13, and a part spherical cover pivotally mounted on the cabinet and having a lower edge, the part spherical cover being mounted in a position such that in a cover closed position, the lower edge of the part spherical cover overlies and mates with an upper edge of the front upright wall of the bag support frame with the bag support frame in the first position, and the part spherical cover being openable in a direction to move the lower edge upwardly away from the upper edge of the front upright wall.

16. The waste receptacle of claim 15 and an actuator movable to pivot the part spherical cover between the cover closed position overlying the upper edge of the front upright wall of the bag support frame, to an open position wherein the part spherical cover is retracted within the cabinet.

17. The waste receptacle of claim 11, wherein the front upright wall is substantially a half of an upright right circular cylinder having a diameter between side edges, the cabinet having a front opening of size to receive a portion of the frame bottom extending rearwardly from a diameter line of the front upright wall with the bag support frame in the first position, a portion of the ring also extending rearwardly of the diameter line with the bag support frame in the first position, and a plurality of casters supporting the bag support frame for movement and rotation.

18. The waste receptacle of claim 17, the front upright wall being configured so a majority of the half of an upright circular cylinder forming the front upright wall extends outwardly from the cabinet with the bag support frame in the first position.

19. The waste receptacle of claim 11 wherein the cabinet has a cabinet bottom wall, a slide and turntable between the cabinet bottom wall and the bottom of the bag support frame for slidably mounting the bag support frame on the cabinet bottom wall and permitting rotation of the bag support frame about an upright axis, the bag support frame being rotatable about the upright axis to move the ring outside the cabinet with the bag support frame in the second position.

20. The waste receptacle of claim 11, wherein the ring has an outwardly rolled part cylindrical top edge, a bag on the bag support frame being positioned on an interior of the ring with a portion of an open end of such bag wrapped around the rolled top edge to an outer side of the ring, and an annular retainer engaging a portion of such bag wrapped to the outer side of the ring and urging the portion of such bag inwardly toward a base wall of the ring.

21. The waste receptacle of claim 20 wherein the rolled top edge of the ring has a pair of notches in the rolled top edge positioned on opposite sides of the ring, the retainer urging the portion of such bag wrapped to the outer side of the ring into the notches.

22. The waste receptacle of claim 21, wherein the rolled top edge of the ring has an inwardly formed recess of size for a finger to grasp an upper edge portion of such bag extending across the recess.

23. A waste receptacle comprising a waste bag holding frame having an upright wall with an upper end and a lower end, a wall support joined to the lower end of the upright wall and extending laterally therefrom to support the upright wall;

a peripheral ring attached to the upper end of the upright wall and extending laterally of the upright wall and spaced upwardly from and at least partially overlying the wall support to provide space between the ring and the wall support for a waste bag, the upright wall configured to support the peripheral ring along a part of a periphery of the peripheral ring only and to leave an unobstructed opening below the peripheral ring opposite from the upright wall, the ring being adapted to support an open upper end of a waste bag that depends from the ring, and the wall support being mounted on support members to permit linear and rotational movement of the waste bag holding frame and the upright wall to provide access to the unobstructed opening for removal of a waste bag below the peripheral ring through the unobstructed opening.

24. The waste receptacle of claim 23 wherein the support members comprise a slide for movably mounting the wall support for linear movement between first and second positions.

25. The waste receptacle of claim 24 and a turntable supported on the slide and rotatably supporting the wall support relative to the slide.

26. The waste receptacle of claim 23, wherein the wall support comprises a bottom wall, and the upright wall being secured to the bottom wall and extending upwardly therefrom, said upright wall having portions supporting the ring at spaced locations part way around the ring, and the support members comprising a plurality of casters supporting the bottom wall for linear and rotational movement of the waste bag holding frame.

27. The waste receptacle of claim 26 wherein the upright wall is a part cylindrical wall and has spaced upright edges that are substantially on a diameter plane of the part cylindrical wall, and wherein the peripheral ring is generally circular, and fits to an interior of the part cylindrical upright wall.

* * * * *